US010503105B2

(12) United States Patent
Imaizumi et al.

(10) Patent No.: US 10,503,105 B2
(45) Date of Patent: Dec. 10, 2019

(54) FIXING APPARATUS HAVING A TUBULAR FILM THAT INCLUDES A LOW RESISTANCE LAYER FORMED IN A HEAT GENERATING LAYER

(71) Applicant: CANON KABUSHIKI KAISHA, Tokyo (JP)

(72) Inventors: Toru Imaizumi, Kawasaki (JP); Ken Nakagawa, Yokohama (JP); Takashi Narahara, Mishima (JP); Takeshi Shinji, Yokohama (JP); Kazuhiro Doda, Yokohama (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/245,606

(22) Filed: Jan. 11, 2019

(65) Prior Publication Data

US 2019/0171145 A1 Jun. 6, 2019

Related U.S. Application Data

(63) Continuation of application No. 15/578,858, filed on Dec. 1, 2017, now Pat. No. 10,216,130.

(51) Int. Cl.
*G03G 15/20* (2006.01)

(52) U.S. Cl.
CPC ..... *G03G 15/2057* (2013.01); *G03G 15/2042* (2013.01); *G03G 15/2053* (2013.01); (Continued)

(58) Field of Classification Search
CPC ..... G03G 15/2017; G03G 15/2039; G03G 15/2053; G03G 15/2057; G03G 15/2078; G03G 2215/2016; G03G 2215/2048
(Continued)

(56) References Cited

U.S. PATENT DOCUMENTS 8,712,300 B2 4/2014 Mukai
9,182,713 B2 11/2015 Narahara et al.
(Continued)

FOREIGN PATENT DOCUMENTS

JP H07-92839 A 4/1995
JP 2000-192943 A 7/2000
(Continued)

OTHER PUBLICATIONS

International Search Report and Written Opinion dated Jul. 19, 2016, in International Application No. PCT/JP2016/002883.
(Continued)

*Primary Examiner* — Benjamin R Schmitt
(74) *Attorney, Agent, or Firm* — Venable LLP

(57) ABSTRACT

A tubular film used for a fixing apparatus includes a heat generating layer, and a first conductive layer and a second conductive layer respectively provided at one end and another end of the film in a longitudinal direction of the film so as to contact the heat generating layer. The first conductive layer and the second conductive layer each has a volume resistivity that is less than that of the heat generating layer. A low resistance layer is formed in an area of the heat generating layer between the first conductive layer and the second conductive layer in the longitudinal direction, so as not to contact the first conductive layer and the second conductive layer. The low resistance layer has a volume resistivity that is less than that of the heat generating layer, and extends in a circumferential direction of the heat generating layer.

21 Claims, 16 Drawing Sheets

(52) U.S. Cl.
CPC . *G03G 15/2064* (2013.01); *G03G 2215/2035* (2013.01); *G03G 2215/2048* (2013.01)

(58) Field of Classification Search
USPC ..... 399/320, 328, 329, 330, 333, 335
See application file for complete search history.

(56) References Cited

U.S. PATENT DOCUMENTS

| | | | |
|---|---|---|---|
| 9,423,737 | B2 | 8/2016 | Narahara et al. |
| 9,915,897 | B2 | 3/2018 | Narahara et al. |
| 2011/0091251 | A1 | 4/2011 | Kim et al. |
| 2011/0150545 | A1 | 6/2011 | Nihonyanagi et al. |
| 2014/0308052 | A1 | 10/2014 | Narahara et al. |
| 2017/0343929 | A1 | 11/2017 | Narahara et al. |

FOREIGN PATENT DOCUMENTS

| | | | |
|---|---|---|---|
| JP | 2006-091449 | A | 4/2006 |
| JP | 2009-258312 | A | 11/2009 |
| JP | 2013-097315 | A | 5/2013 |
| JP | 2014-206579 | A | 10/2014 |

OTHER PUBLICATIONS

International Preliminary Report on Patentability dated Jan. 4, 2018, in International Application No. PCT/JP2016/002883.
Extended European Search Report dated Dec. 6, 2018, issued in European Patent Application No. 16813927.7.

FIXING APPARATUS HAVING A TUBULAR FILM THAT INCLUDES A LOW RESISTANCE LAYER FORMED IN A HEAT GENERATING LAYER

This application is a continuation of U.S. patent application Ser. No. 15/578,858, filed Dec. 1, 2017, which is a U.S. national stage application of International Application No. PCT/JP2016/002883, filed Jun. 15, 2016, which claims priority from Japanese Patent Application No. 2015-125037, filed Jun. 22, 2015, and No. 2016-113423, filed Jun. 7, 2016. Each of the priority applications is hereby incorporated by reference herein in its entirety.

BACKGROUND OF THE INVENTION

Technical Field

The present invention relates to a heating apparatus used, for example, for image forming apparatuses, such as printers and copiers, and a heating rotating member used for the heating apparatus.

Description of the Related Art

As a heating apparatus used for conventional image forming apparatuses, such as printers and copiers, for example, the heating apparatus described in Japanese Patent Application Laid-open No. 2013-97315 is known.

This heating apparatus has a heating rotating member, a power feeding member for feeding power to the heating rotating member, and a pressurizing member that comes into pressure contact with the heating rotating member to form a nip portion. By feeding power to the heating rotating member to generate Joule heat, the heating apparatus allows high-speed start-up and saves energy. The heating rotating member has a heat generating layer coated with an insulating layer. The heating rotating member generates heat by feeding power directly to the heat generating layer, enabling a reduction in warm-up time.

Technical Problem

In the conventional heating rotating member, however, the insulating layer may be damaged by being rubbed by foreign matter entering the image forming apparatus or by recording materials, and the damage may even reach the heat generating layer. Moreover, for example, in connection with a jam eliminating process forcibly executed by a user, the heat generating layer may be damaged by a cutter. The heat generating layer damaged in this manner may locally increase a current density around ends of the damaged portion of the heat generating layer, leading to abnormal heat generation in the corresponding portions.

SUMMARY OF THE INVENTION

Solution to Technical Problem

An object of the present invention is to provide a tubular film used for a fixing apparatus, the tubular film including a heat generating layer, and a first conductive layer and a second conductive layer provided respectively at one end and another end of the film in a longitudinal direction of the film, so as to contact the heat generating layer. The first conductive layer and the second conductive layer both have a lower volume resistivity than that of the heat generating layer. In addition, the tubular film includes a low-resistance layer formed in an area of the heat generating layer between the first conductive layer and the second conductive layer in the longitudinal direction so as not to contact the first conductive layer and the second conductive layer. The low-resistance layer has a lower volume resistivity than that of the heat generating layer and extends in a circumferential direction of the heat generating layer.

Another object of the present invention is to provide a tubular film used for a fixing apparatus, the tubular film including a heat generating layer, and a plurality of low-resistance layers formed in an area of the heat generating layer at least except for one end and another end of the film in a longitudinal direction of the film. The low-resistance layers are formed at intervals in the longitudinal direction so as not to contact one another, and the low-resistance layers have a lower volume resistivity than that of the heat generating layer and extend in a circumferential direction of the heat generating layer.

Yet another object of the present invention is to provide a fixing apparatus that fixes an image to a recording material, the fixing apparatus including a heating rotating member having a heat generating layer, and a first conductive layer and a second conductive layer provided respectively at one end and another end of the heating rotating member in a longitudinal direction of the heating rotating member so as to contact the heat generating layer. The first conductive layer and the second conductive layer both have a lower volume resistivity than that of the heat generating layer. Power feeding members contact the first conductive layer and the second conductive layer, respectively. The heat generating layer generates heat by a current flowing between the power feeding members and the heat generating layer, and the image is fixed to the recording material by heat from the heating rotating member. In addition, the heating rotating member has a low-resistance layer formed in an area of the heat generating layer between the first conductive layer and the second conductive layer in the longitudinal direction so as not to contact the first conductive layer and the second conductive layer, and the low-resistance layer has a lower volume resistivity than that of the heat generating layer and extends in a circumferential direction of the heat generating layer.

Still another object of the present invention is to provide a fixing apparatus that fixes an image to a recording material, the fixing apparatus including a heating rotating member having a heat generating layer, and power feeding members that contact one end and another end of the heating rotating member in a longitudinal direction of the heating rotating member. The heat generating layer generates heat by a current flowing between the power feeding members and the heat generating layer. A pressurizing member forms a nip portion in cooperation with the heating rotating member. In the nip portion, the recording material on which the image is formed is heated while being conveyed to fix the image to the recording material. In addition, the heating rotating member has a plurality of low-resistance layers formed in a conveying area for the recording material in the heat generating layer at intervals in the longitudinal direction so as not to contact one another, each of the low-resistance layers having a lower volume resistivity than that of the heat generating layer and extending in a circumferential direction of the heat generating layer.

Further features of the present invention will become apparent from the following description of exemplary embodiments with reference to the attached drawings.

BRIEF DESCRIPTION OF THE DRAWINGS

FIG. 1A is a front schematic view, and FIG. 1B is an enlarged sectional schematic view taken along a longitudinal direction.

FIG. 3A is a sectional view of the fixing apparatus, and FIG. 3B is a perspective view of the fixing apparatus.

DESCRIPTION OF THE EMBODIMENTS

The present invention will be described below in detail based on illustrated embodiments.

In the description below, a longitudinal direction represents a generatrix direction of a cylindrical shape of a heating rotating member surface. A circumferential direction represents a rotating direction of the heating rotating member surface corresponding to a circumferential direction of the cylindrical shape of the heating rotating member surface. A thickness direction represents a radial direction of the cylindrical shape of the heating rotating member surface.

Embodiment 1

FIGS. 1A to 5B depict a fixing film 1 serving as a heating rotating member and a fixing apparatus according to Embodiment 1 of the present invention.

First, a configuration of the fixing film 1 serving as the heating rotating member will be described. Then, a fixing apparatus using the fixing film 1 will be described.

Description of the Fixing Film

Figure 1A:
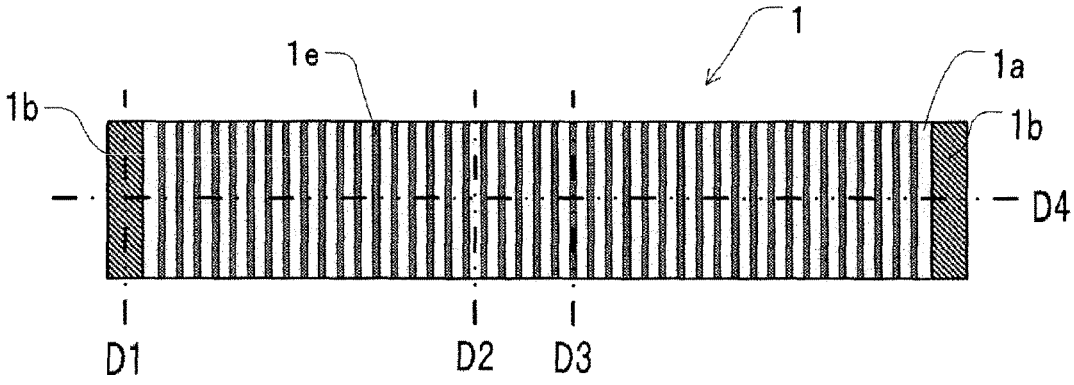
FIG. 1A and FIG. 1B depict a fixing film serving as a heating rotating member according to Embodiment 1 of the present invention. More specifically.
Figure 1B:
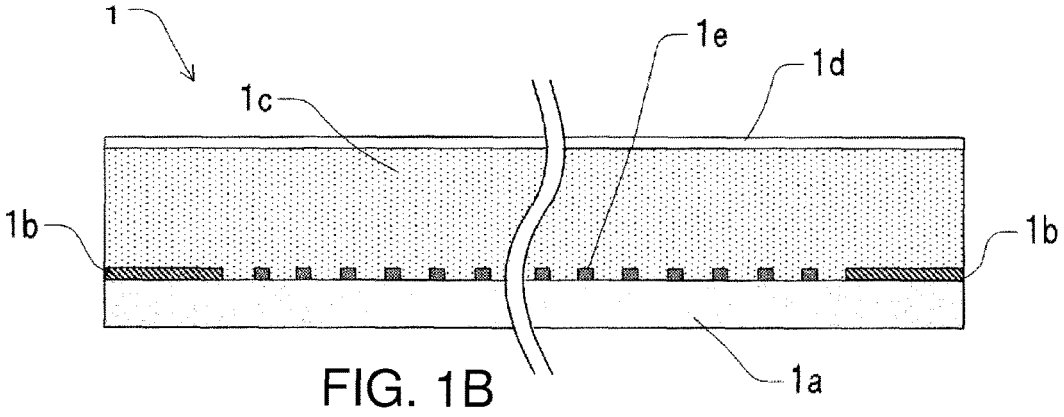
Figure 2A:
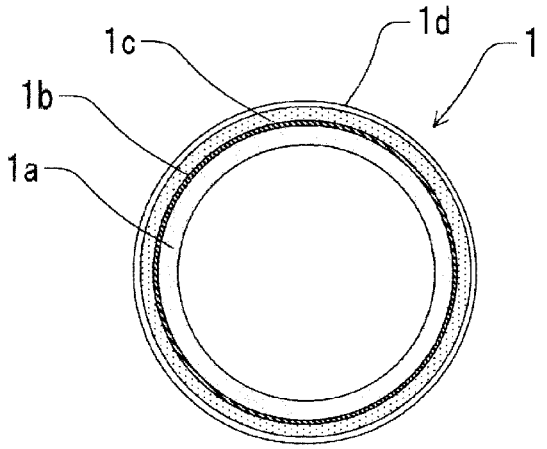
FIGS. 2A to 2C are sectional schematic diagrams of the fixing film shown in FIG. 1A and FIG. 1B.
Figure 2B:
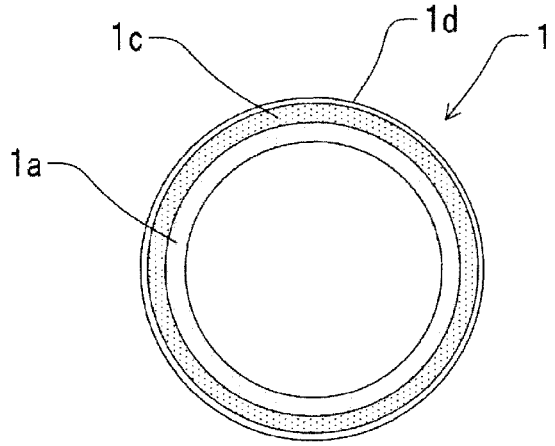
Figure 2C:
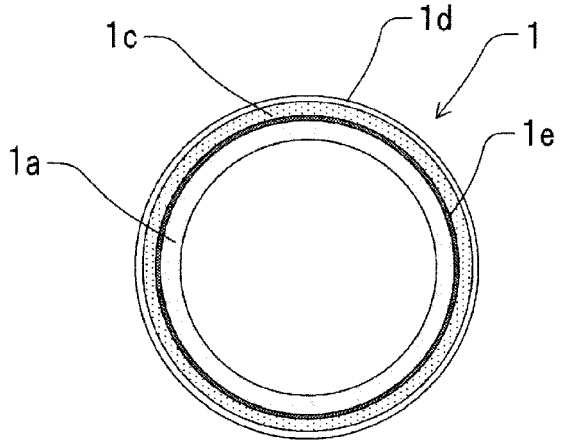
Figure 3A:
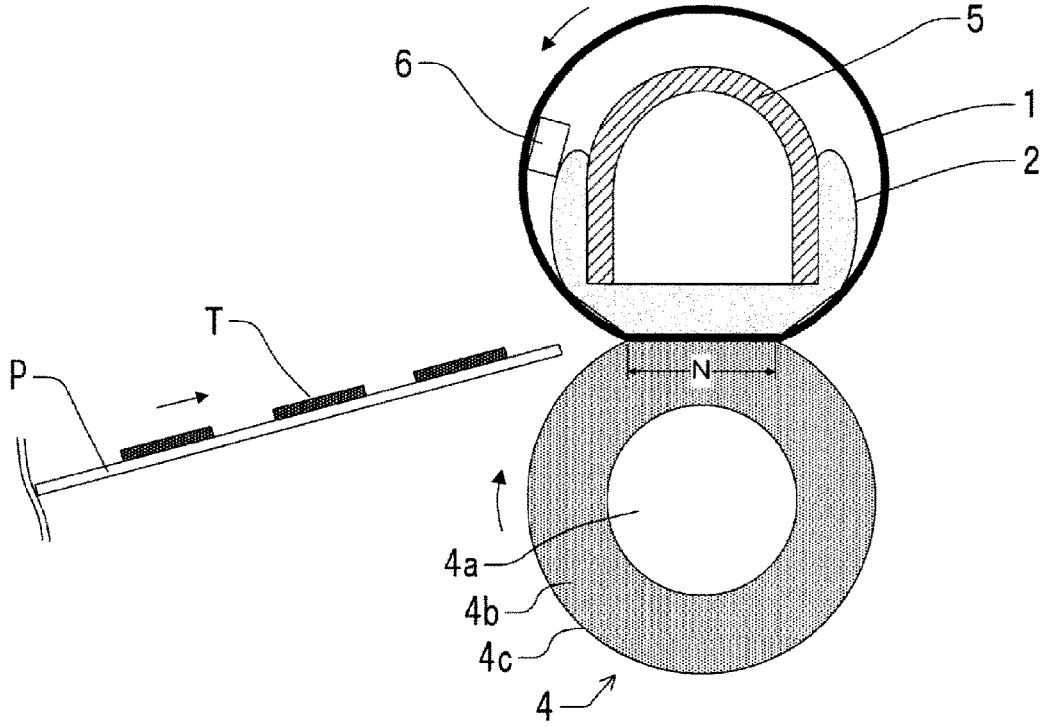
FIG. 3A and FIG. 3B schematically depict a fixing apparatus that is a heating apparatus using the fixing film shown in FIG. 1A and FIG. 1B. More specifically.
Figure 3B:
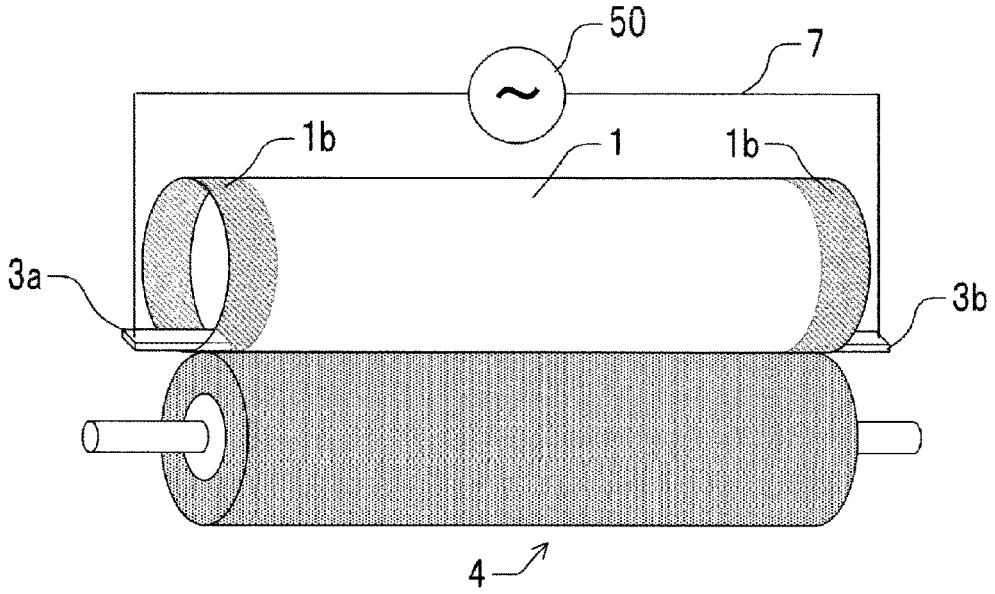

A configuration of a fixing film 1 in Embodiment 1 of the present invention will be described using FIG. 1A and FIG. 1B, FIG. 2A to FIG. 2C, and FIG. 3A and FIG. 3B. FIG. 1A and FIG. 1B are schematic diagrams illustrating arrangement of a low-resistance layer 1*e* as viewed from the front. FIG. 2A is a sectional view of a longitudinal end of the fixing film 1 taken along line D1 in FIG. 1A. FIG. 2B and FIG. 2C are sectional views of the fixing film 1 taken along lines D2 and D3 in FIG. 1A, respectively, depicting a portion of the fixing film 1 located close to a longitudinally central portion thereof and not including the low-resistance layer 1*e*, and a portion of the fixing film 1 located close to a longitudinally central portion thereof and including the low-resistance layer 1*e*, respectively. FIG. 3A and FIG. 3B are sectional views of the fixing film 1 taken along line D4 in a longitudinal direction in FIG. 1A.

As depicted in FIG. 1A and FIG. 1B, the fixing film 1 is a thin flexible cylindrical member having a cylindrical heat generating layer 1*a*. The fixing film 1 has a laminate structure. Conductive layers 1*b* are formed at respective opposite ends of the heat generating layer 1*a* all along a circumference thereof, and have a smaller volume resistivity than that of the heat generating layer 1*a*. Moreover, on the heat generating layer 1*a*, the linear low-resistance layer 1*e* having a smaller volume resistivity than that of the heat generating layer 1*a* is provided. The conductive layers 1*b* have a first conductive layer provided at one end of the heat generating layer 1*a* in the longitudinal direction of the fixing film 1, and a second conductive layer provided at the other end of the heat generating layer 1*a* in the longitudinal direction of the fixing film 1. The low-resistance layer 1*e* extends in a direction crossing the longitudinal direction of the heat generating layer 1*a*, and, in the illustrated example, extends along a circumferential direction of the heat generating layer 1*a* orthogonally to the longitudinal direction of the heat generating layer 1*a*.

The heat generating layer 1*a* is a base layer that provides the fixing film 1 with mechanical properties, such as torsional strength and smoothness. The heat generating layer 1*a* is formed of a resin, such as polyimide (PI), polyamideimide (PAI), or polyether ether keton (PEEK). A conductive filler that is carbon, metal, etc. is dispersed in the heat generating layer 1*a* such that an alternating current is applied through the conductive layers 1*b* to adjust electric resistance so as to allow heat generation.

For example, the heat generating layer 1*a* used is a polyimide film that has an outside diameter of φ18, a longitudinal length of 240 mm, and a thickness of 60 μm, and in which carbon is dispersed as the conductive filler. The heat generating layer 1*a* has a volume resistivity set to approximately 0.03 Ω·cm.

The conductive layers 1*b* are provided over a predetermined width, for example, within the range of approximately 10 mm, from the respective opposite ends of the fixing film 1 in the longitudinal direction in order to supply power to the heat generating layer 1*a* through an inner surface of the fixing film 1. In the present embodiment, a silver paste is formed all over a surface of the heat generating layer 1*a* in the circumferential direction thereof as the conductive layer 1*b* for power feeding. In a specific example, the conductive layers 1*b* are formed of a silver paste with a volume resistivity of $4\times10^{-5}$ Ω·cm. As the silver paste, silver particulates are dispersed in a polyimide resin using a solvent and then are fired. When the conductive layers 1*b* are formed on the heat generating layer 1*a*, the value of resistance between the conductive layers 1*b* at the opposite ends of the heat generating layer 1*a* in the longitudinal direction is set to, for example, approximately 19.3Ω.

An elastic layer 1*c* is formed of silicone rubber that has a predetermined thickness and in which a thermally conductive filler is dispersed. A release layer 1*d* is subjected to a coating treatment with a fluorine resin, for example, PFA (tetrafluoroethylene perfluoroalkylvinylether copolymer) so as to be set to have a layer thickness of approximately 15 μm. The elastic layer 1*c* and the release layer 1*d* are electrically insulated.

Furthermore, the present embodiment is characterized in that, besides the conductive layers 1*b* provided at the longitudinal ends for power feeding, a large number of endless, low-resistance layers 1*e*, each extending linearly in the circumferential direction, are formed in the longitudinal direction in order to form an equipotential surface. That is, each of the linear low-resistance layers 1*e* is continuous in the circumferential direction and is shaped like an independent ring. In the present embodiment, the low-resistance layers 1*e*, used to form the equipotential surface, are formed of a silver paste with a volume resistivity of $4\times10^{-5}$ Ω·cm that is the same as the silver paste of which the conductive layers 1*b* are formed. A ratio of the volume resistance value of the low-resistance layers 1*e* to the volume resistance value of the heat generating layer 1*a* is preferably within the range from 1/1000 to 1/100. Desirably, the low-resistance layers 1*e* are formed of a flexible material and have a thickness of 100 μm or less so as not to prevent the heat generating layer 1*a* from being deformed. The effects of the present example can be produced with the width of each low-resistance layer 1*e* set to any value, so long as the width is appropriate to achieve conductivity. The width, however, is desirably 5 μm or more in view of pattern chipping and stability of a line width. In the present embodiment, as depicted in FIG. 1A and FIG. 1B, a large number of the low-resistance layers 1*e* with an equal thickness and an equal width are arranged at equal intervals and equal pitches in the longitudinal direction between the conductive layers 1*b* provided at the ends. The low-resistance layers 1*e* are provided so as not to contact the conductive layers 1*b*. Specific dimensions are such that the interval and the width are set to 0.4 mm and 0.1 mm, respectively, and that the pitch and the thickness are set to 0.5 mm and approximately 10 μm, respectively.

Since a current passes through the low-resistance layers 1*e* extending in the circumferential direction in an endless manner, areas in which the respective low-resistance layers 1*e* are formed each generate a smaller amount of heat than each area of the heat generating layer 1*a* between adjacent low-resistance layers 1*e* with the low-resistance layer 1*e* not being formed therein. Consequently, an excessively large width of the low-resistance layer 1*e* is likely to lead to nonuniform temperatures on the surface of the fixing film 1. Thus, each low-resistance layer 1*e* is desirably 0.1 mm or more and 5 mm or less in width. Furthermore, the interval between the low-resistance layers 1*e* is desirably smaller than a circumferential length of the heat generating layer 1*a* (in the present embodiment, 57 mm). Moreover, a smaller interval between the low-resistance layers 1*e* allows the effects of the present embodiment to be more easily exerted but makes normal heat generating areas smaller. This results in a higher likelihood of a fluctuation in resistance caused by a variation in coating of the low-resistance layers 1*e* and joining of the adjacent low-resistance layers 1*e*. For example, when the adjacent low-resistance layers 1*e* are partly joined together, a reduced current flows through the heat generating layer 1*a* between these adjacent low-resistance layers 1*e*. Then, no heat is generated in this area, resulting in uneven heat generation. To ensure the above-described balance, the specific dimension of the interval between the low-resistance layers 1*e* is preferably set to 0.2 mm or more.

In the present embodiment, if the heat generating layer 1*a* has an actual resistance value of 18.0Ω at the opposite ends thereof in the longitudinal direction when the conductive layers 1*b* and the low-resistance layers 1*e* are formed on the heat generating layer 1*a*, the heat generating layer 1*a* has an actual resistance value of 19.3Ω at the opposite ends thereof in the longitudinal direction when only the conductive layers 1*b* are formed on the heat generating layer 1*a*. Formation of the low-resistance layers 1*e* reduces the total resistance of the fixing film 1 by 1.3Ω.

Furthermore, in the present embodiment, the conductive layers 1*b* for power feeding and the low-resistance layers 1*e* for equipotential-surface formation are provided on the same surface of the fixing film 1. The conductive layers 1*b* for power feeding and the low-resistance layers 1*e* for equipotential-surface formation may, however, be provided on different surfaces. For example, the conductive layers 1*b* may be provided on an inner surface of the fixing film 1, whereas the low-resistance layers 1*e* may be provided on an outer surface of the fixing film 1. Additionally, in the present embodiment, the low-resistance layers 1*e* are formed by printing the silver paste. The low-resistance layers 1*e* may be formed, however, by any other means, such as metal plating or sputtering.

Description of the Fixing Apparatus

Now, a configuration of a fixing apparatus that is a heating apparatus in Embodiment 1 of the present invention will be described using FIG. 3A and FIG. 3B. FIG. 3A is a sectional view of a longitudinally central portion of the fixing apparatus, and FIG. 3B is a schematic diagram of the fixing apparatus as viewed in the longitudinal direction.

The fixing apparatus is configured to heat and fix a toner image T formed on a recording material P using a general electrophotographic image forming method. That is, the fixing apparatus includes a cylindrical fixing film 1 serving as a heating rotating member, a film guide 2 that holds an inner peripheral surface of the fixing film 1, and a pressurizing roller 4 that forms a nip N between the pressurizing roller 4 and the film guide 2 via the fixing film 1. Then, the recording material P bearing the toner image T is conveyed from a left side in FIG. 3A by conveying means (not depicted in the drawings), sandwiched and conveyed through the nip N, and pressurized and heated to heat and fix the toner image T to the recording material P.

The film guide 2 is formed of a heat resistant resin, such as a liquid crystal polymer, PPS, or PEEK, and is engaged, at opposite ends of the film guide 2 in the longitudinal direction, with a fixing stay 5 held by an apparatus frame. A pressurizing spring (not depicted in the drawings), serving as pressurizing means, pressurizes the fixing stay 5 at the opposite ends thereof in the longitudinal direction to pressurize the film guide 2 toward the pressurizing roller 4. In order to transmit, in the longitudinal direction of the film guide 2, the pressure received at the opposite ends of the fixing stay 5 in the longitudinal direction evenly, the fixing stay 5 has a high rigidity increased by forming the fixing stay 5 using a rigid material, such as iron, stainless steel, or a zinc chromate coat steel plate, such that the fixing stay 5 has a U-shaped section. Consequently, with possible deflection of the film guide 2 suppressed, the fixing nip N is formed that has a uniform predetermined width in the longitudinal direction of the pressurizing roller 4. Furthermore, a temperature sensing element 6 is installed on the film guide 2 and is in abutting contact with an inner surface of the fixing film 1. Conduction of a current through the fixing film 1 is controlled according to a temperature detected by the temperature sensing element 6.

The low-resistance layers 1*e* of the fixing film 1 are desirably provided in a paper passing area for the recording material P that has at least the minimum width at which the recording material P can pass through the paper passing area.

In the present embodiment, a liquid crystal polymer is used as a material for the film guide 2, and a zinc chromate coat steel plate is used as a material for the fixing stay 5. A pressurizing force applied to the pressurizing roller 4 is 160 N, and, at this time, the fixing nip N is formed to be approximately 6 mm in size.

The pressurizing roller 4 includes a cored bar 4*a* formed of a material such as iron or aluminum, an elastic layer 4*b* formed of a material such as silicone rubber, and a release layer 4*c* formed of a material such as PFA. The pressurizing roller 4 preferably has a hardness of approximately 40° to 70° under a 1-kgf load, as measured using an ASKER-C durometer, so as to achieve appropriate durability and an appropriate fixing nip N width for satisfactory fixability.

Specifically, a silicone rubber layer is formed on the iron cored bar 4*a* of φ11 to a thickness of 3.5 mm as the elastic layer 4*b*, and then is coated with an insulating PFA tube with a thickness of 40 μm as the release layer 4*c*. The pressurizing roller 4 has a surface hardness of 56° and an outside diameter of φ18. The elastic layer 4*b* and the release layer 4*c* have a longitudinal length of 240 mm.

Furthermore, power feeding members 3*a*, 3*b* are connected to an AC power supply 50 through AC cables 7 and are disposed inside the fixing nip N at the opposite ends thereof so as to be pressed toward and against the pressurizing roller 4. In the present embodiment, as the power feeding members 3*a*, 3*b*, carbon brushes are used that are formed of metal graphite containing approximately 60% of copper. An AC voltage from the AC power supply 50 is applied to the carbon brushes via the AC cables 7 to achieve power feeding to the ends of the heat generating layer 1*a* of the fixing film 1. The power feeding members 3*a*, 3*b* are pressed against the rubber of the pressurizing roller 4 over a width of 6 mm in a conveying direction so as to protrude into the fixing nip N to a position 6 mm away from each of the opposite ends of the fixing nip N.

In the present embodiment, the conductive layers 1*b* are provided at the respective opposite ends of the heat generating layer 1*a* of the fixing film 1. This allows suppression of nonuniform heating in the circumferential direction of the fixing film 1. This is because the resistance value of the heat generating layer 1*a* of the fixing film 1 is much smaller in a thickness direction than in the longitudinal direction, causing a current from the power feeding members 3*a*, 3*b* to pass through the heat generating layer 1*a* in the thickness direction and then to uniformly flow all along the circumference of the heat generating layer 1*a* via the conductive layers 1*b*. The heat generating layer 1*a* has a resistance value of several mΩ in the thickness direction, and thus, the heat generation in this direction is not important. Furthermore, power is fed not from an outer peripheral side of the fixing film 1 around which the conductive layers 1*b* are formed, but from an inner peripheral side of the fixing film 1, preventing the conductive layers 1*b* from being scraped by the power feeding members 3*a*, 3*b*. Thus, stable power feeding can be achieved through durability.

A turning force from a driving mechanism portion (not depicted in the drawings) is transmitted to a driving gear G for the pressurizing roller 4, and then, the pressurizing roller 4 is rotationally driven at a predetermined speed in a counterclockwise direction as depicted in FIG. 3A and FIG. 3B. In conjunction with the rotational driving by the pressurizing roller 4, a frictional force is exerted between the pressurizing roller 4 and the fixing film 1 at the fixing nip portion N, causing a turning force to act on the fixing film 1. Consequently, the inner surface of the fixing film 1 comes into close contact with the film guide 2, and, while sliding on the film guide 2, the fixing film 1 externally rotates around the film guide 2 counterclockwise, as depicted in FIG. 3A and FIG. 3B, in conjunction with rotation of the pressurizing roller 4.

Rotation of the pressurizing roller 4 rotates the fixing film 1 to allow a current to conduct through the fixing film 1, elevating the temperature of the fixing film 1 to a predetermined value. Then, based on temperature information acquired by the temperature sensing element 6, the temperature is controlled. A recording material P with an unfixed toner image T is introduced, and at the fixing nip portion N, a toner image bearing surface of the recording material P is sandwiched and conveyed through the fixing nip portion N along with the fixing film 1. During this sandwiched conveyance process, the recording material P is heated by heat from the fixing film 1, and the unfixed toner image T on the recording material P is heated ad pressurized, and thus melted and fixed onto the recording material P. The recording material P having passed through the fixing nip portion N is curved and separated from the surface of the fixing film 1 and is discharged. The discharged recording material P is then conveyed by a discharging roller pair (not depicted in the drawings).

Effects of Embodiment 1

Figure 4A:
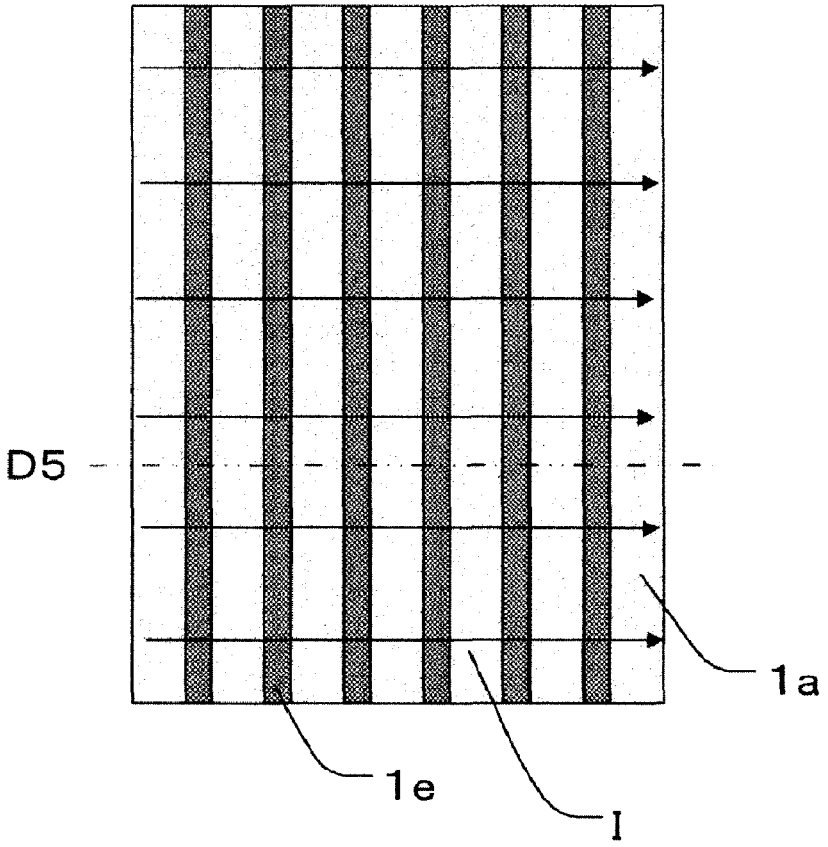
FIG. 4A and FIG. 4B are diagrams illustrating flows of currents through the fixing film in a normal state.
Figure 4B:
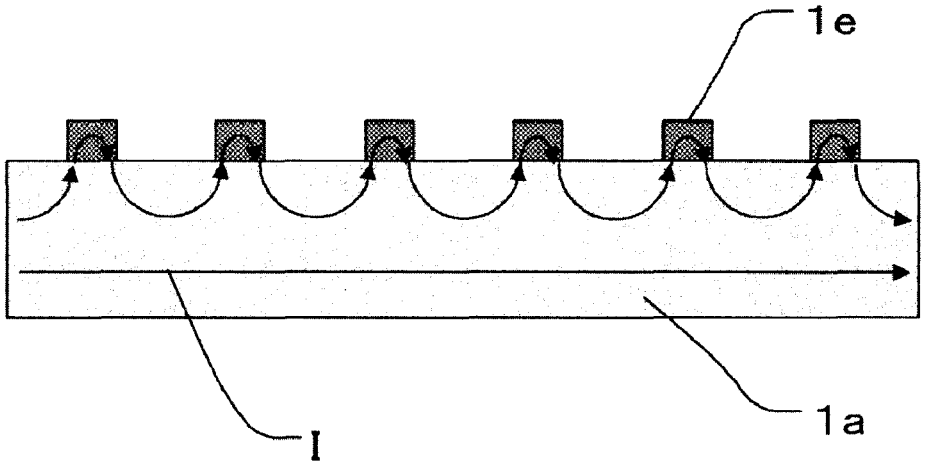

FIG. 4A and FIG. 4B are schematic diagrams depicting flows of currents through the fixing film 1 in Embodiment 1. FIG. 4A is a front schematic diagram of the longitudinally central portion of the fixing film 1. FIG. 4B is a sectional schematic diagram of the fixing film 1 in FIG. 4A taken along line D5 in the thickness direction. FIG. 4A and FIG. 4B illustrate only the heat generating layer 1*a* and the low-resistance layers 1*e*, and illustration of the other portions is omitted.

In a normal state in which no crack C is formed, currents I flow in the longitudinal direction, as depicted in FIG. 4A. In the normal state, as depicted in FIG. 4A, substantially no current I flows through the low-resistance layer 1*e* in the circumferential direction unless the thickness or the resistivity of the heat generating layer 1*a* varies. In the thickness direction, the currents I flow such that currents I flowing near the surface of the heat generating layer 1*a* flow mainly through the low-resistance layers 1*e* in portions of the heat generating layer 1*a* at which the respective low-resistance layers 1*e* are formed, and uniformly through the heat generating layer 1*a* in portions thereof at which no low-resistance layer 1*e* is formed, as depicted in FIG. 4B. Currents I flowing through the low-resistance layers 1*e* do not substantially contribute to heat generation due to the small resistance of each low-resistance layer 1*e*. The portions of the heat generating layer 1*a* at which no low-resistance layer 1*e* is formed significantly contribute to heat generation.

Figure 5A:
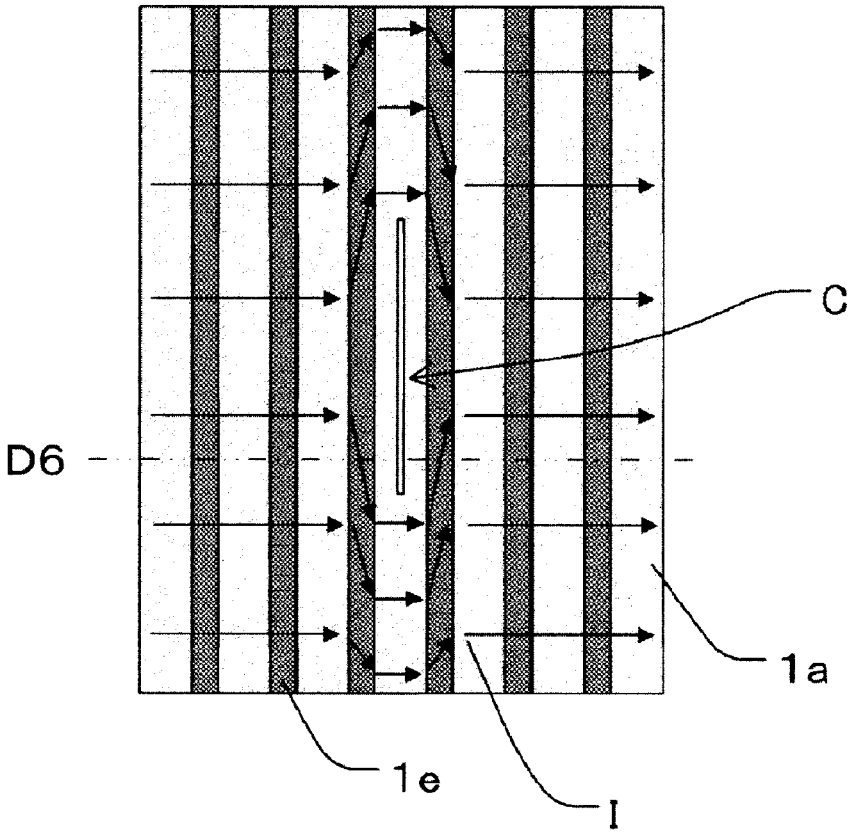
FIG. 5A and FIG. 5B are diagrams illustrating flows of currents through the fixing film when cracking occurs.
Figure 5B:
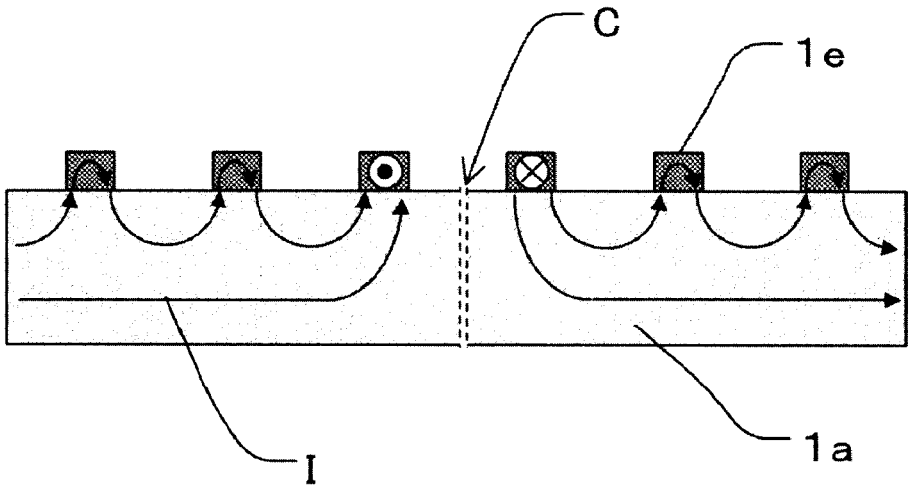

Now, a crack C is assumed to be formed in the fixing film 1. FIG. 5A is a front schematic diagram illustrating a case in which the crack C is formed in the fixing film 1 shown in FIG. 4A. FIG. 5B is a sectional schematic diagram of the fixing film 1 shown in FIG. 5A taken along line D6 in the thickness direction.

In such a case, with no low-resistance layer 1*e*, flows of the currents I are blocked by the crack C, and thus, the currents I bypass the crack portion C, causing abnormal heat generation near ends of the crack C.

Figure 16:
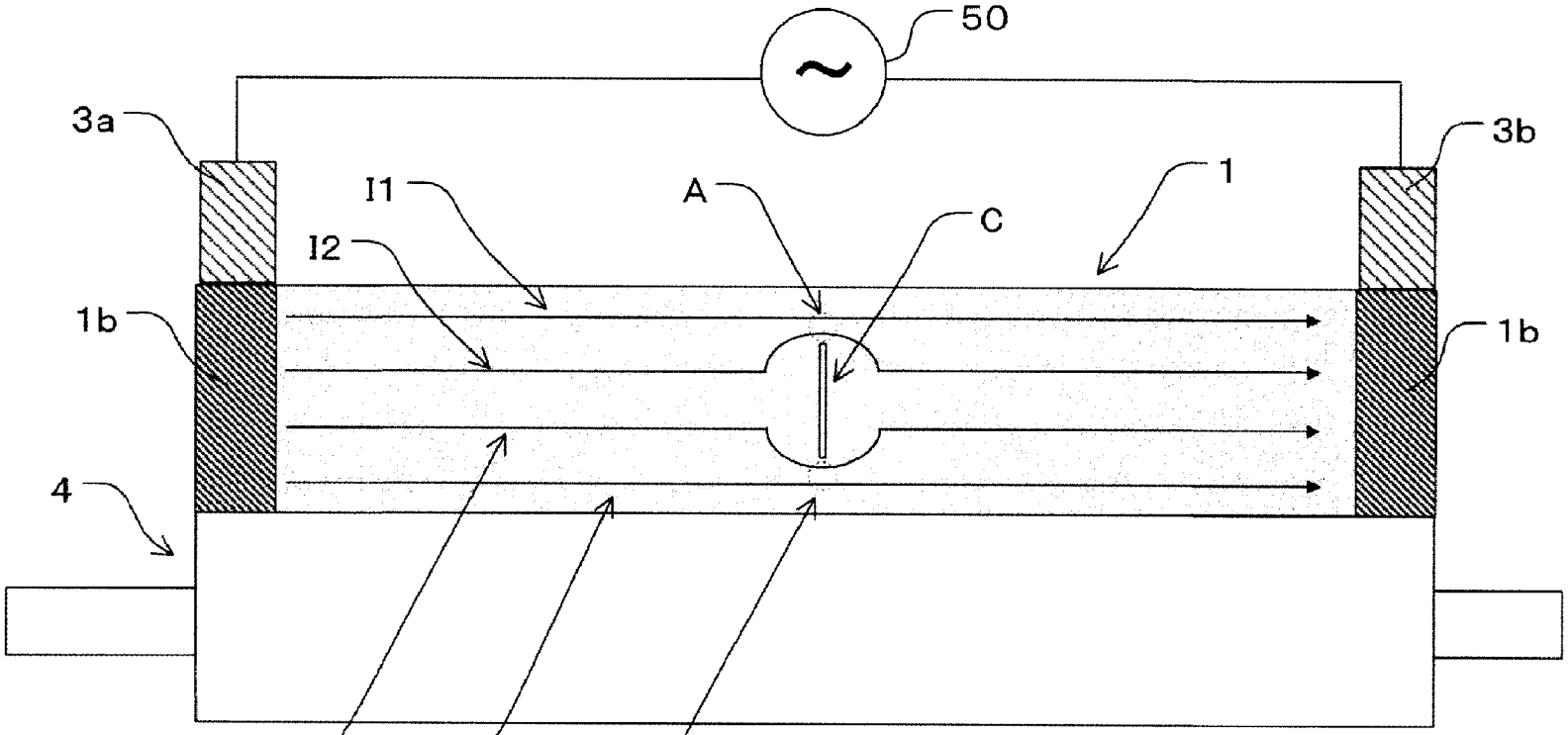
FIG. 16 is a referential drawing illustrating flows of currents through a fixing film with no low-resistance layer when cracking occurs.

FIG. 16 is a referential drawing illustrating that when, a crack C is formed as a result of damage to the heat generating layer 1*a* in a case in which no low-resistance layer 1*e* is formed, currents I concentrate near the ends of the crack C.

Reference characters I1 to I4 denote currents flowing through the heat generating layer 1*a* at a certain point of time. Provision of the conductive layers 1*b* allows currents I1 to U4 to flow uniformly, in the normal state, through the heat generating layer 1*a* of the fixing film 1 in the longitudinal direction, enabling uniform heat generation.

As depicted in FIG. 16, when a crack C is formed as a result of damage to the heat generating layer 1*a*, however, the crack C blocks traveling of currents I2, I3, and the currents I2, I3 flow around the ends of the crack portion C to bypass the crack C. Thus, in areas A and B around the ends, a current density increases at one point in a concentrated manner, leading to local abnormal heat generation at that point.

The portion in which abnormal heat generation has occurred has a much higher temperature than the normal portions, increasing the likelihood that the fixing film 1 will be thermally damaged or inappropriate images will be formed.

In contrast, in Embodiment 1, since a large number of the low-resistance layers 1*e* for equipotential surface formation are formed, even when a crack C is generated, the currents I bypass the crack C by passing through the low-resistance layers 1*e* as depicted in FIG. 5A. As a result, the currents I are prevented from bypassing the crack C in the heat generating layer 1*a* as in the referential example, and in the heat generating layer 1*a* between the low-resistance layers 1*e*, the currents I flow in a direction perpendicular to edges of the low-resistance layers 1*e*, that is, in the longitudinal direction. Since the low-resistance layers 1*e* offer sufficiently low resistance as compared to the heat generating layer 1*a*, the amount of heat generated in the low-resistance layers 1*e* as a result of the currents I passing through the low-resistance layers 1*e* is small and not important.

As viewed in the thickness direction, as in FIG. 5B, a current I having reached the low-resistance layer 1*e* in front of the crack C flows through the low-resistance layer 1*e* in a direction perpendicular to the sheet of FIG. 5B, bypasses the crack C, then flows into the next low-resistance layer 1*e*, and returns to a current path similar to the normal current path. The above-described mechanism enables a reduction in local current concentration in the heat generating layer 1*a* caused by the crack C.

The low-resistance layers 1*e* are desirably continuous in the circumferential direction. The effects of the present invention can be exerted, however, even when the low-resistance layers 1*e* are partly discontinued. In other words, the linear low-resistance layers 1*e* are desirably provided that extend in the direction orthogonal to the currents I flowing in the longitudinal direction of the fixing film 1, or in the circumferential direction. The direction of the low-resistance layers 1*e* is not, however, limited to the orthogonal direction, and the effects of the present invention can be effected even when the low-resistance layers 1*e* are inclined relative to the currents I, so long as the low-resistance layers 1*e* extend in a direction traversing the currents I. The currents I flow between the conductive layers 1*b* provided at the opposite ends of the fixing film 1 in the longitudinal direction.

Furthermore, in the present embodiment, the low-resistance layers 1*e* are formed all over an area of the fixing film 1 over which the recording material P can be passed. Thus, wherever, in the heat generating layer 1*a* in the longitudinal direction, a crack C is formed as a result of foreign matter, a staple, or the like that rushes into the fixing apparatus along with the recording material P, abnormal heat generation can be reduced.

As described above, in Embodiment 1, a plurality of the low-resistance layers 1*e* that offers lower resistance than the heat generating layer 1*a* is formed on the heat generating layer 1*a* so as to traverse the currents I flowing through the heat generating layer 1*a*. This configuration enables a reduction in local current concentration when the heat generating layer 1*a* is cracked, resulting in a reduction in abnormal heat generation.

In the present example, the conductive layers 1*b* are provided. The present invention is not, however, limited to this configuration. Any configuration is possible, so long as the low-resistance layers 1*e* are formed in the areas of the heat generating layer 1*a* at least except for one end and the other end of the heat generating layer 1*a*.

Embodiment 2

Now, Embodiment 2 of the present invention will be described with reference to FIG. 6A to FIG. 8B. Embodiment 2 uses a fixing roller 10 as a heating rotating member.

Also in the present embodiment, first, a configuration of a fixing roller 10 will be described, and then, a fixing apparatus using the fixing roller 10 will be described.

Description of the Fixing Roller

Figure 6A:
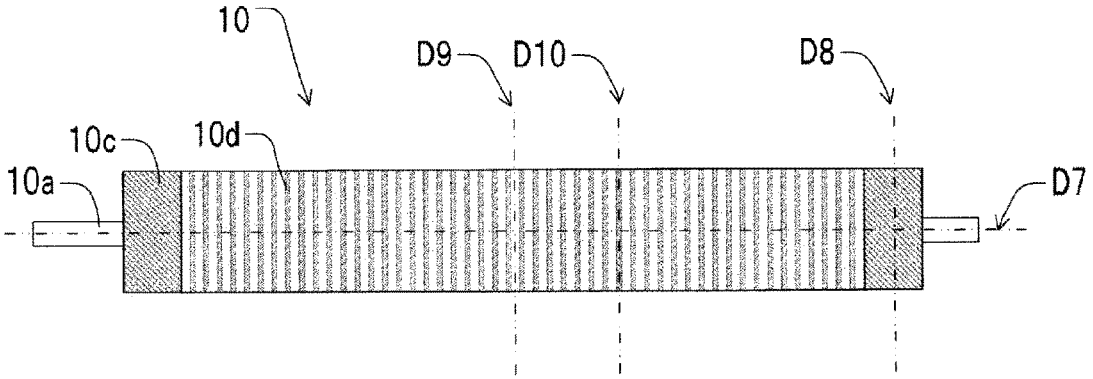
FIG. 6A and FIG. 6B depict a fixing roller serving as a heating rotating member according to Embodiment 2 of the present invention.
Figure 6B:
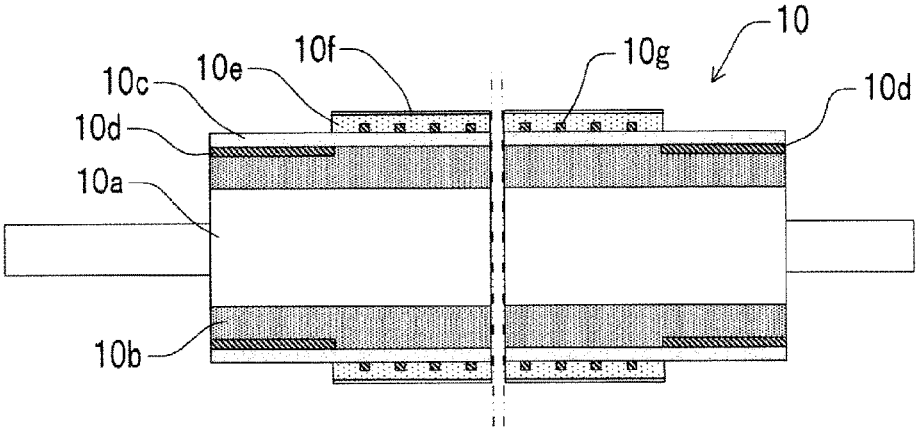
Figure 7A:
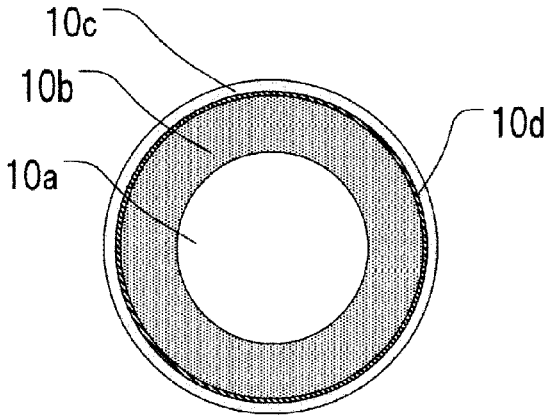
FIGS. 7A to 7C are sectional schematic diagrams of the fixing roller shown in FIG. 6A and FIG. 6B.
Figure 7B:
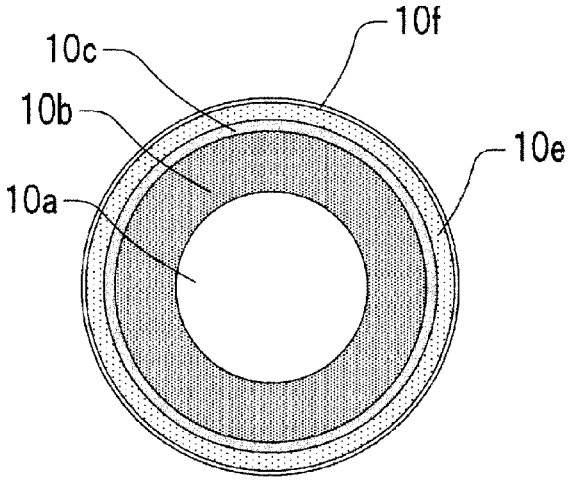
Figure 7C:
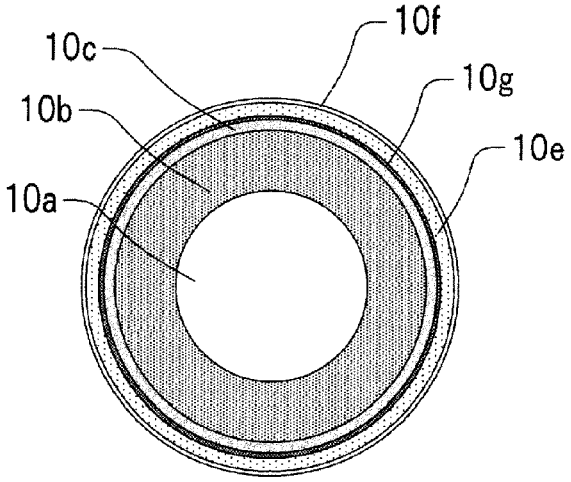

FIG. 6A is a front schematic diagram of the fixing roller 10. FIG. 6B is a sectional schematic diagram of the fixing roller 10 shown in FIG. 6A, taken along line D7. Furthermore, FIG. 7A is a sectional schematic diagram of the fixing roller 10 shown in FIG. 6A taken along line D8. FIG. 7B is a sectional schematic diagram of the fixing roller 10 shown in FIG. 6A taken along line D9. FIG. 7C is a sectional schematic diagram of the fixing roller 10 shown in FIG. 6A taken along line D10.

The fixing roller 10 has a cored bar 10*a* serving as a rotating shaft, a sponge rubber layer 10*b* shaped like a roller, arranged concentrically and integrally around the cored bar 10*a*, and serving as an elastic layer, and a heat generating layer 10*c* provided on the sponge rubber layer 10*b* and containing, for example, a resin provided with conductivity by adding a conductive filler to the resin. Moreover, conductive layers 10*d* for power feeding having a predetermined width are formed on an inner surface of the heat generating layer 10*c* at respective opposite ends thereof. The width of each of the conductive layers 10*d* are set to, for example, approximately 10 mm. An elastic layer 10*e* and a release layer 10*f* are provided on the heat generating layer 10*c*. Furthermore, besides the conductive layers 10*d* provided on the heat generating layer 10*c* at the respective opposite ends thereof for power feeding, a large number of linear low-resistance layers 10*g* extending in the circumferential direction and configured to form an equipotential surface are formed along the longitudinal direction.

In a specific example, for example, a cored bar 10*a* formed of stainless steel and having an outside diameter of 11 mm was used, and for the sponge rubber layer 10*b*, an open-cell sponge rubber was used which was formed by containing resin balloons and a foaming agent in solid silicone rubber and vaporizing the foaming agent to join the resin balloons together. The heat generating layer 10*c* was the same as the heat generating layer 1*a* used for the fixing film 1 in Embodiment 1. The conductive layers 10*d* for power feeding were formed of the same material as the conductive layers 1*b* in Embodiment 1 and had the same thickness as the conductive layers 1*b* in Embodiment 1. However, the conductive layers 10*d* are formed on the inner surface of the heat generating layer 10*c* because the fixing roller 10 feeds power through an outer peripheral surface thereof. The elastic layer 10*e* and the release layer 10*f* were also formed of the same materials as the elastic layer 1*c* and the release layer 1*d* in Embodiment 1 and had the same thicknesses as those in Embodiment 1. The 10-mm areas at the longitudinally opposite ends of the heat generating layer 10*c* are not formed, however, because power is fed to the heat generating layer 10*c* through ends of the outer peripheral surface of the fixing roller 10. Areas at which the heat generating layer 10*c* is exposed are contact areas to which power is fed by the power feeding members 3*a* and 3*b*. The low-resistance layers 10*g* were also formed of the same material as the low-resistance layers 1*e* in Embodiment 1, had the same thickness and width as those in Embodiment 1, and were formed on the heat generating layer 10*c* between the conductive layers 10*d* at the same intervals as those in Embodiment 1.

Desirably, the fixing roller 10 in the present embodiment has an outside diameter of, for example, approximately 18 mm, and has a hardness of 30° to 70° under a load of 5.9 N as measured using an ASKER-C durometer, so as to achieve an appropriate fixing nip N and appropriate durability. Specifically, the hardness was set to 52°. Furthermore, as in the case of Embodiment 1, the heat generating layer 10*c* is 240 mm in length.

Description of the Fixing Apparatus

Figure 8A:
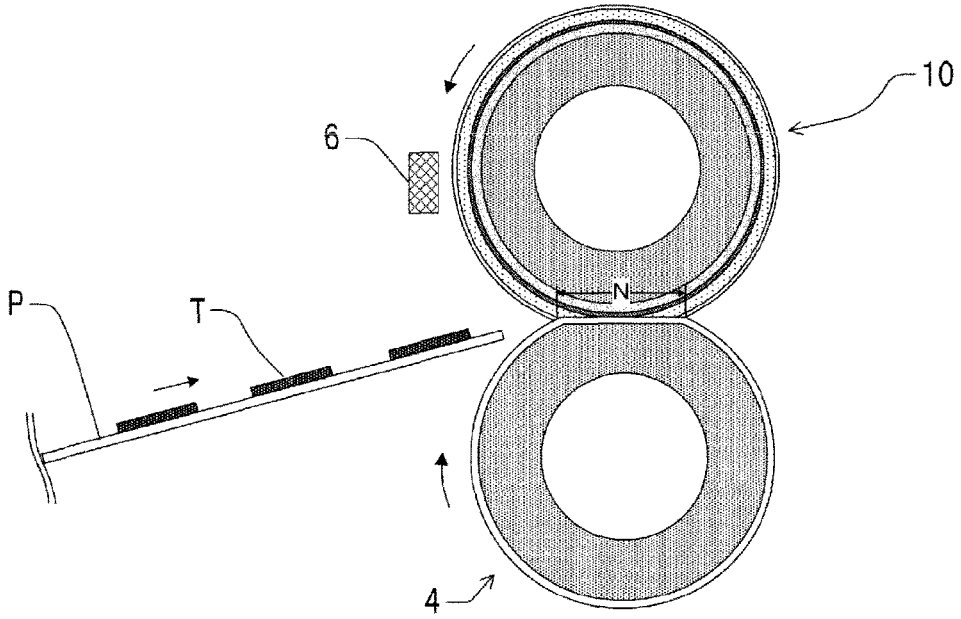
FIG. 8A and FIG. 8B are schematic diagrams of a fixing apparatus that is a heating apparatus using the fixing roller shown in FIG. 6A and FIG. 6B.
Figure 8B:
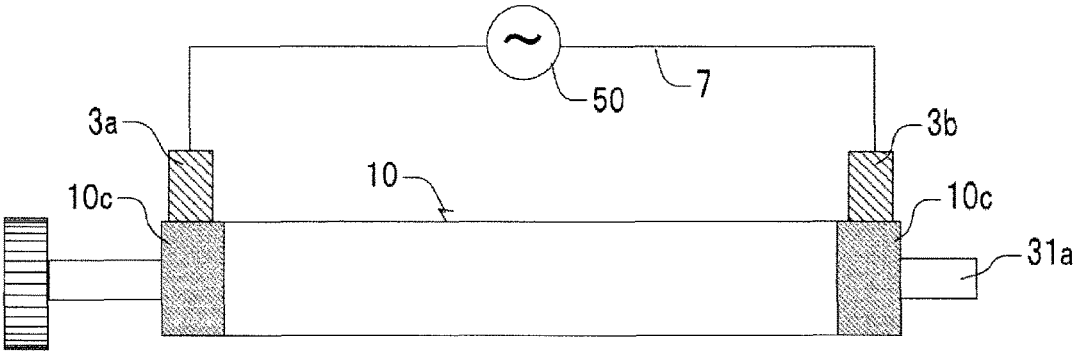

FIG. 8A is a sectional schematic diagram of a main part of a fixing apparatus in Embodiment 2. FIG. 8B is a front schematic diagram of the fixing apparatus.

The fixing apparatus in Embodiment 2 includes a cylindrical fixing roller 10 serving as a heating rotating member, and a pressurizing roller 4 serving as a pressurizing member that forms a fixing nip N in cooperation with the fixing roller 10.

The fixing roller 10 and the pressurizing roller 4 are pressurized by pressuring means (not depicted in the figures) to form a fixing nip N with a predetermined width that is uniform in the longitudinal direction of the pressurizing roller 4. Furthermore, a non-contact temperature sensing element 6 is installed on the surface of the fixing roller 10 to detect the temperature of the fixing roller 10. Conduction of a current through the fixing roller 10 is controlled according to the temperature detected by the temperature sensing element 6.

Power feeding members 3*a*, 3*b* are connected to an AC power supply 50 through AC cables 7 and are disposed at ends of the fixing nip N located at the respective opposite portions thereof so as to be pressed toward and against the fixing roller 10. In the present embodiment, carbon brushes formed of metal graphite were used as the power feeding members 3*a*, 3*b*, as is the case with Embodiment 1. An AC voltage from an AC power supply 50 is applied to the carbon brushes via the AC cables 7 to achieve power feeding to the ends of the heat generating layer 10*c* of the fixing roller 10.

Specifically, the power feeding members 3*a*, 3*b* were pressed against the heat generating layer 10*c* of the fixing roller 10 over a width of 6 mm in the longitudinal direction and over a width of 6 mm in the conveying direction at a pressurizing force of 4 N.

A turning force from a driving mechanism portion (not depicted in the drawings) is transmitted to a driving gear G attached to the fixing roller 10 that is then rotationally driven at a predetermined speed in a counterclockwise direction, as depicted in FIG. 8A. In conjunction with the rotational driving by the fixing roller 10, a frictional force is exerted between the fixing roller 10 and the pressurizing roller 4 at the fixing nip portion N, causing a turning force to act on the pressurizing roller 4. Consequently, the pressurizing roller 4 is driven and rotated.

A current is conducted through the fixing roller 10 to elevate the temperature of the fixing roller 10 to a predetermined value. Then, the temperature is controlled by the temperature sensing element 6. A recording material P with an unfixed toner image T is introduced, and at the fixing nip portion N, a toner image bearing surface of the recording material P is sandwiched and conveyed through the fixing nip portion N along with the fixing roller 10. Then, a fixing operation is performed. The recording material P having passed through the fixing nip portion N is curved and is separated from the surface of the fixing roller 10, and then is discharged. The discharged recording material P is then conveyed by a discharging roller pair (not depicted in the drawings).

Effects of Embodiment 2

Also in Embodiment 2, a large number of the linear low-resistance layers 10*g* offering lower resistance than the heat generating layer 10*c* are formed on the heat generating layer 10*c* so as to traverse currents flowing through the heat generating layer 10*c*. In this configuration, a mechanism similar to the mechanism in Embodiment 1 enables a reduction in local current concentration when a crack C is formed in the heat generating layer 10*c*, resulting in a reduction in abnormal heat generation.

Furthermore, in Embodiment 2, the heat generating layer 10*c* is bonded to and backed up by the sponge rubber layer 10*b*, unlike in Embodiment 1 in which the heat generating layer 10*c* is shaped like a film. Thus, even if the heat generating layer 10*c* is damaged by a flaw, the configuration of Embodiment 2 enables a reduction in the likelihood that the damage will be developed as a result of the subsequent use of the fixing roller 10. This, in turn, enables a further reduction in the likelihood of abnormal heat generation.

In the present embodiment, the pressurizing roller 4 is used as the pressurizing member. A pressurizing film unit, however, using a driven pressuring film, for example, may be used as the pressurizing member.

Embodiment 3

Figure 9:
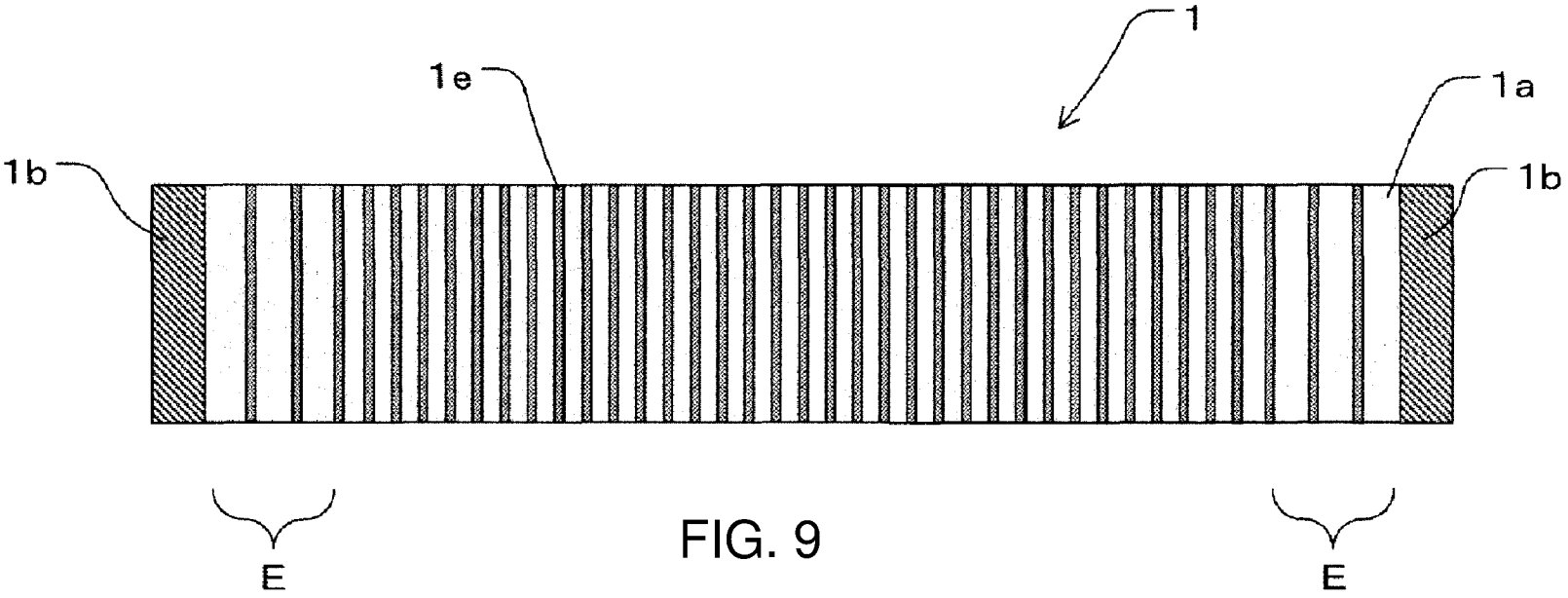
FIG. 9 is a front schematic view of a fixing film serving as a heating rotating member according to Embodiment 3 of the present invention.

Now, Embodiment 3 of the present invention will be described using FIG. 9.

In Embodiment 3, a large number of the low-resistance layers 1*e* for equipotential surface formation are formed, as is the case with Embodiment 1. In the present embodiment, however, a heat generation distribution is varied in the longitudinal direction by setting the low-resistance layers 1*e* to have the same width, but varying the interval between the low-resistance layers 1*e* in the longitudinal direction. The remaining part of the configuration of Embodiment 3 is similar to the corresponding part of the configuration of Embodiment 1, and will thus not be described.

In areas in which the respective conductive layers 1*b* for power feeding are formed, substantially all the currents pass through the conductive layers 1*b*. Thus, the areas with the conductive layers 1*b* are substantially prevented from generating heat. Consequently, when a certain amount of time has elapsed since the start of temperature control, heat may travel to the ends of the fixing film 1, and temperature sagging may occur in which the temperature becomes lower in areas E of the fixing film 1 at the opposite ends thereof in the longitudinal direction than in the central portion of the fixing film 1 in the longitudinal direction. Prevention of this phenomenon can be achieved by increasing a heat generation density in the areas E. To change the heat generation density, means may be used, such as changing the thickness or the volume resistivity of the heat generating layer 1*a* only in the areas E. Such means may, for example, affect the strength of the fixing film 1, or make manufacturing difficult.

In Embodiment 3, the intervals at which the low-resistance layers 1*e* are formed are increased only in the areas E, each of which is located inside the area in which the conductive layer 1*b* is formed. Specifically, only for the low-resistance layers 1*e* in each area E that is 10 mm in size, the interval between the low-resistance layers 1*e* is changed from 0.4 mm to 0.9 mm with the width of each low-resistance layer 1*e* kept at 0.1 mm. As described in Embodiment 1, each low-resistance layer 1*e* has a lower volume resistivity than that of the heat generating layer 1*a*. Thus, the area in which the low-resistance layers 1*e* are formed has a lower resistance and a lower heat generation density than those of the area in which no low-resistance layer 1*e* is formed. When low-resistance layers 1*e* with a 0.9 mm interval and each with a width of 0.1 mm were formed all over the fixing film 1 in the longitudinal direction thereof, the fixing film 1 had a total resistance value of 18.7Ω. As described in Embodiment 1, when the low-resistance layers 1*e* with a 0.4 mm interval and each with a width of 0.1 mm are formed all over the fixing film 1 in the longitudinal direction thereof, the fixing film 1 has a resistance value of 18.0Ω. In the areas E in which the interval between the low-resistance layers 1*e* is locally increased to 0.9 mm, the resistance value is approximately 4% larger than the resistance value in the other portions of the fixing film 1, and thus, the amount of heat generated can accordingly be increased.

In Embodiment 3, the resistance is adjusted by varying the coating interval of the low-resistance layers 1*e*. The resistance can, however, be adjusted by varying a coating width of low-resistance layers 1*e*, that is, by varying the width of the low-resistance layers. In that case, portions in which the low-resistance layers 1*e* have a smaller width have a relatively large amount of heat generated, whereas portions in which the low-resistance layers 1*e* have a larger width have a relatively small amount of heat generated. Furthermore, both the interval and width of the low-resistance layers 1*e* may be varied. In short, the heat distribution in the longitudinal direction can be adjusted by locally varying at least one of the width of each low-resistance layer 1*e* and the interval between the low-resistance layers 1*e*. As described above, in addition to producing the effects of Embodiment 1, Embodiment 3 allows the resistance to be adjusted by varying the coating interval or the coating width of the low-resistance layers 1*e*, enabling the heat generation distribution to be easily adjusted.

Embodiment 4

Figure 10A:
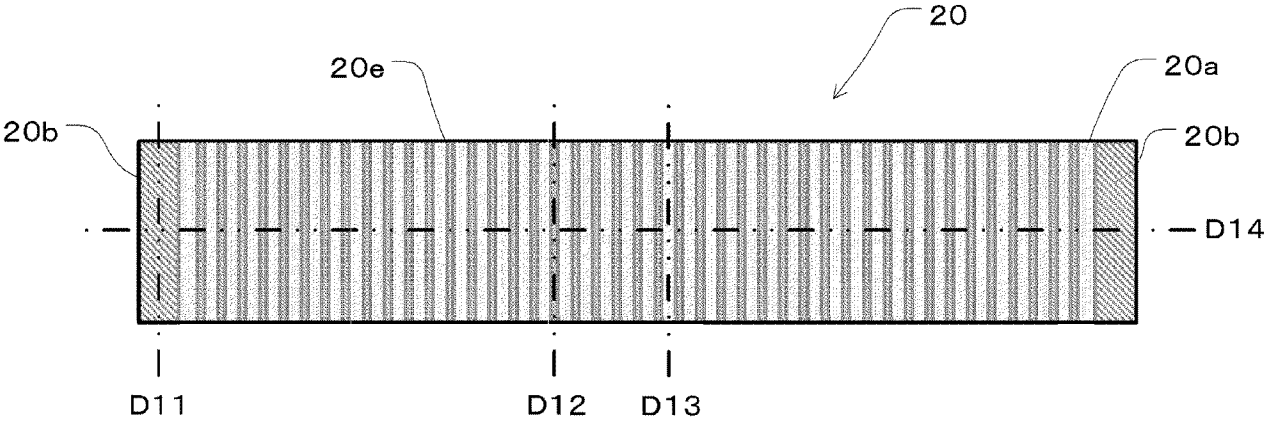
FIG. 10A and FIG. 10B are schematic diagrams of a fixing film serving as a heating rotating member according to Embodiment 4 of the present invention.
Figure 10B:
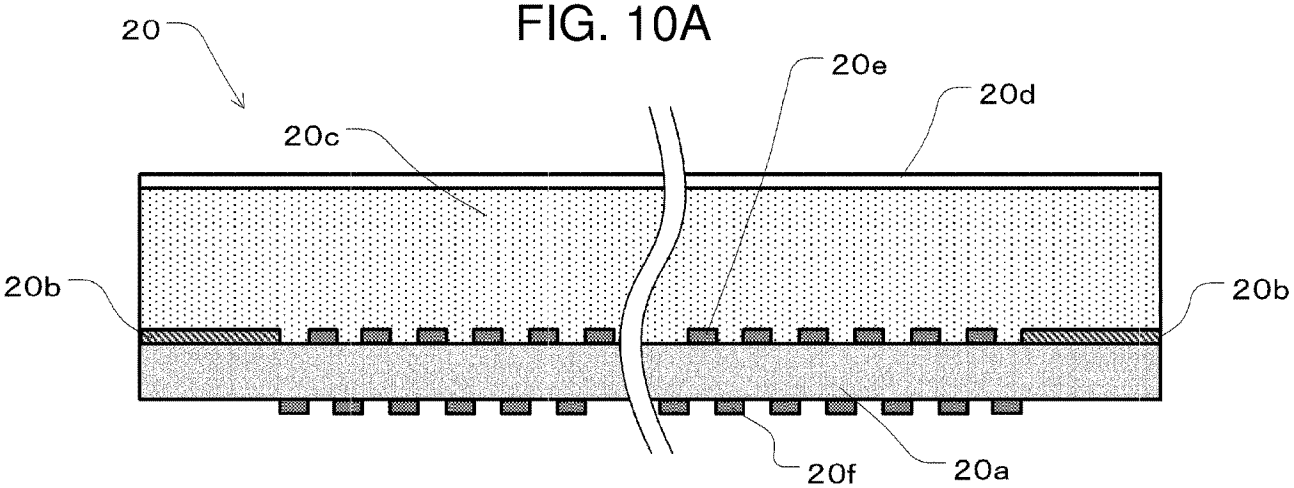
Figure 11A:
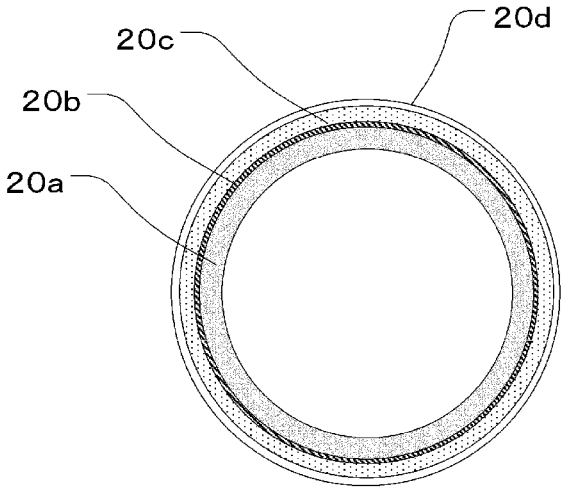
FIGS. 11A to 11C are sectional schematic diagrams of the fixing film shown in FIG. 10A and FIG. 10B.
Figure 11B:
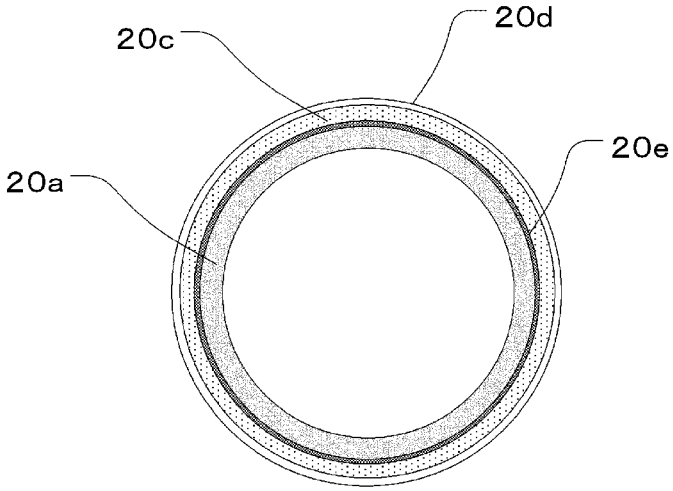
Figure 11C:
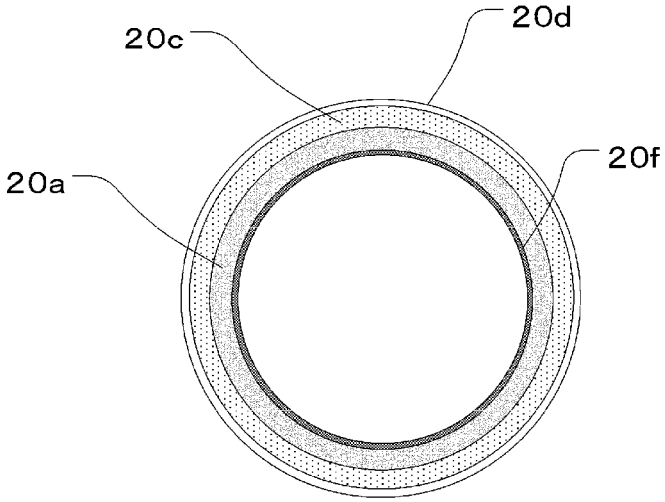

Now, a configuration of a fixing film 20 in Embodiment 4 of the present invention will be described using FIG. 10A and FIG. 10B and FIG. 11A to FIG. 11C. FIG. 10A is a schematic diagram illustrating an arrangement of low-resistance layers 20*e* as viewed from the front. FIG. 11A is a sectional view of a longitudinal end of the fixing film 20 taken along line D11 in FIG. 10A. FIG. 11B and FIG. 11C are sectional views of a portion of the fixing film 20 near a longitudinally central portion thereof in which the low-resistance layer 20*e* is provided on an outer surface and a portion of the fixing film 20 near the longitudinally central portion thereof in which no low-resistance layer 20*e* is provided on the outer surface, taken respectively along lines D12 and D13 in FIG. 10A. FIG. 10B is a sectional view of the fixing film 20 taken along line D14 in FIG. 10A in the longitudinal direction.

In Embodiment 4, a large number of the low-resistance layers 20*e* for equipotential surface formation are formed on the outer surface of a heat generating layer 20*a* as is the case with Embodiment 1. In the present embodiment, however, low-resistance layers 20*f* are also formed on an inner surface of the heat generating layer 20*a*, and the low-resistance layers 20*f* on the inner surface are each formed on the opposite side of a portion of the heat generating layer 20*a* in which no low-resistance layer 20*e* is present on the outer layer of the heat generating layer 20*a*.

The heat generating layer 20*a* is formed of a material offering higher resistance than the heat generating layer 1*a* in Embodiment 1. The volume resistivity of the heat generating layer 20*a* was adjusted to approximately 0.07 Ω·cm by dispersing carbon in polyimide. The thickness of the heat generating layer 20*a* was set to 75 μm. As a material for the low-resistance layers 20*e*, 20*f*, a silver paste with a volume resistivity of $4\times10^{-5}$ Ω·cm was used, as is the case with Embodiment 1. For both the low-resistance layers 20*e* and 20*f*, the thickness was approximately 10 μm, both the interval and the width were 0.3 mm, and the pitch was 0.6 mm. The low-resistance layers 20*e*, 20*f* were formed such that the low-resistance layers 20*e* on the outer surface were shifted in phase from the low-resistance layers 20*f* on the inner surface by 0.3 mm. Conductive layers 20*b*, an elastic layer 20*c*, and a release layer 20*d* have configurations similar to the corresponding configurations in Embodiment 1 and will thus not be described.

In the present embodiment, the fixing film 20 has an actual resistance value of 17.8Ω at the opposite ends of the fixing film 20 in the longitudinal direction when the conductive layers 20*b* and the low-resistance layers 20*e*, 20*f* are formed on the heat generating layer 20*a*. The fixing film 20 has an actual resistance value of 36Ω at the opposite ends of the fixing film 20 in the longitudinal direction when only the conductive layers 20*b* are formed on the heat generating layer 20*a*. Thus, the total resistance of the fixing film 20 is reduced to approximately half by providing the low-resistance layers 20*e*, 20*f* on both surfaces of the heat generating layer 20*a*.

Furthermore, in the present embodiment, the low-resistance layers 20*e* on the outer surface and the low-resistance layers 20*f* on the inner surface are formed of the same silver paste. Different materials, however, may be used for the outer surface and for the inner surface so long as the materials have a smaller volume resistivity than that of the heat generating layer 20*a*.

Figure 12A:
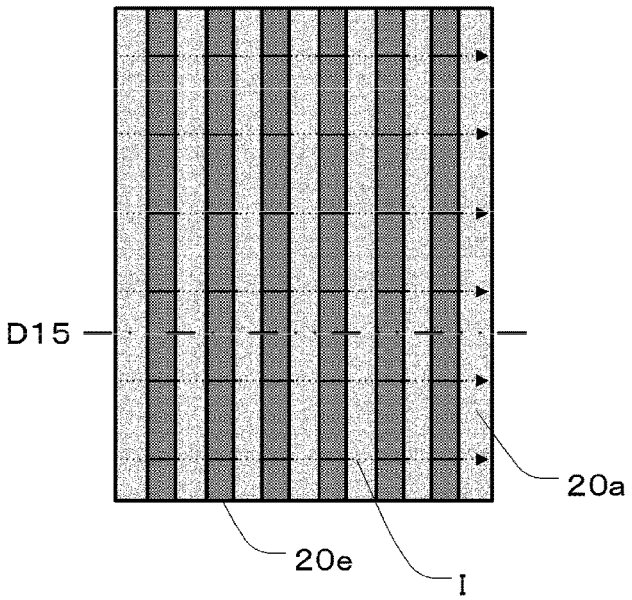
FIGS. 12A to 12C are diagrams depicting flows of currents through the fixing film in the normal state according to Embodiment 4.
Figure 12B:
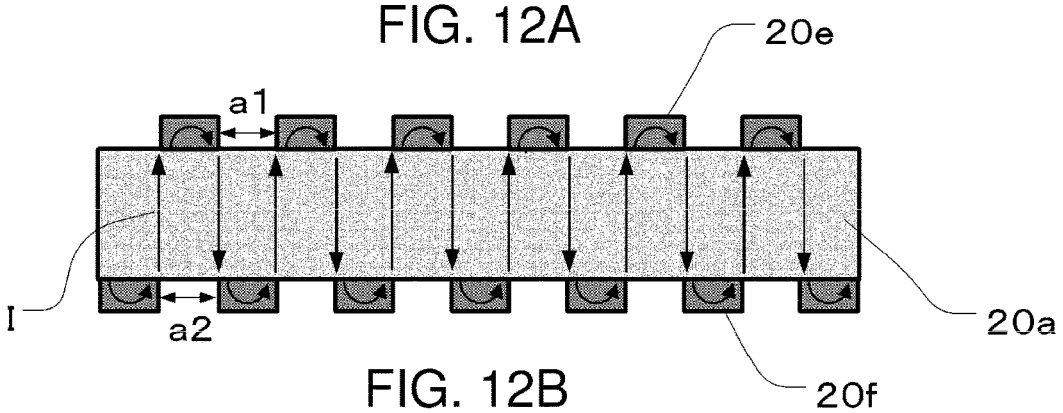
Figure 12C:
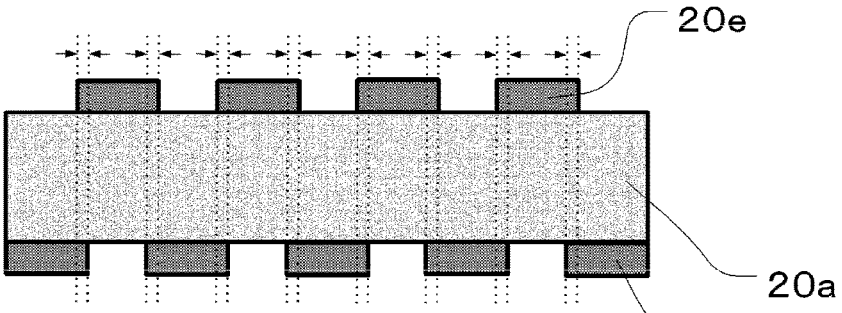

FIGS. 12A to 12C are schematic diagrams depicting flows of currents I in the fixing film 20 in Embodiment 4. FIG. 12A is a front schematic diagram of a longitudinally central portion of the fixing film 20. FIG. 12B is a sectional schematic diagram of the fixing film 20 taken along line D15 in FIG. 12A in the thickness direction of the fixing film 20. FIG. 12A to FIG. 12C depict only the heat generating layer 20*a* and the low-resistance layers 20*e*, 20*f*, and illustration of the other portions is omitted.

In the normal state in which no cracking occurs, currents I flow alternately in the thickness direction of the heat generating layer 20*a* and through the low-resistance layers 20*e* or 20*f* in the longitudinal direction as depicted in FIG. 12B. In the present example, the low-resistance layers 20*e*, 20*f* have the lowest volume resistivity, the interval a1 between the low-resistance layers 20*e* on the same surface of the heat generating layer 20*a* is 0.3 mm, the interval a2 between the low-resistance layers 20*f* on the same surface of the heat generating layer 20*a* is 0.3 mm, and the shortest distance between the low-resistance layers 20*e* and 20*f* on the opposite surfaces of the heat generating layer 20*a* is 75 μm, corresponding to the thickness of the heat generating layer 20*a*. Thus, the currents I flow in the thickness direction of the heat generating layer 20*a* to cause the heat generating layer 20*a* to generate heat. The currents I flowing through the low-resistance layers 20*e*, 20*f* do not contribute to heat generation due to the small resistance of the low-resistance layers 20*e*, 20*f*. When the interval between the low-resistance layers 20*e*, 20*f* on the same surface of the heat generating layer 20*a* is larger than the shortest distance between the low-resistance layers 20*e* and 20*f* on the opposite surfaces of the heat generating layer 20*a* (that is, the thickness of the heat generating layer 20*a*), the currents I flow in the thickness direction of the heat generating layer 20*a*. When this relation is satisfied, the low-resistance layers 20*e* and 20*f* may have overlapping areas as depicted by arrows in FIG. 12C in the thickness direction of the heat generating layer 20*a*.

Figure 13A:
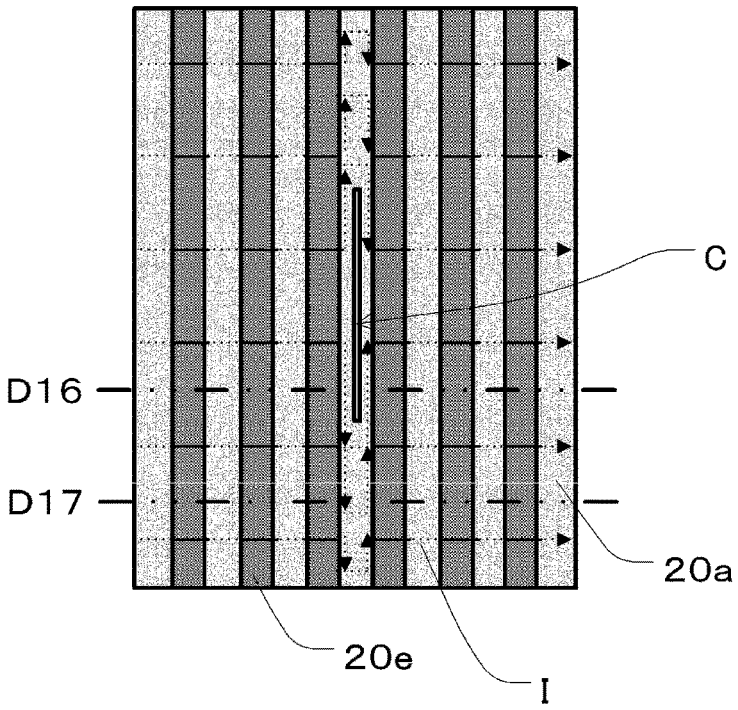
FIGS. 13A to 13C are diagrams depicting flows of currents through the fixing film when cracking occurs according to Embodiment 4.
Figure 13B:
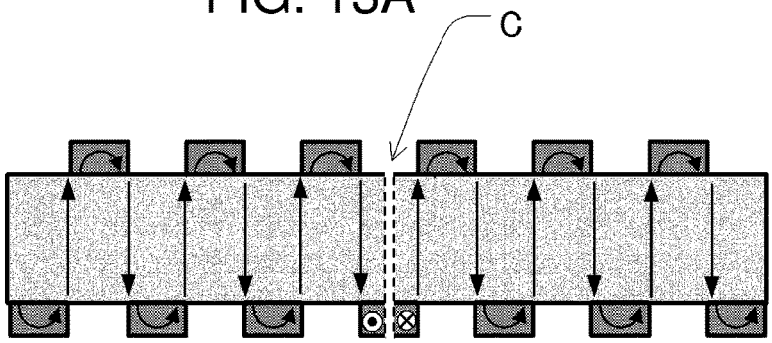
Figure 13C:
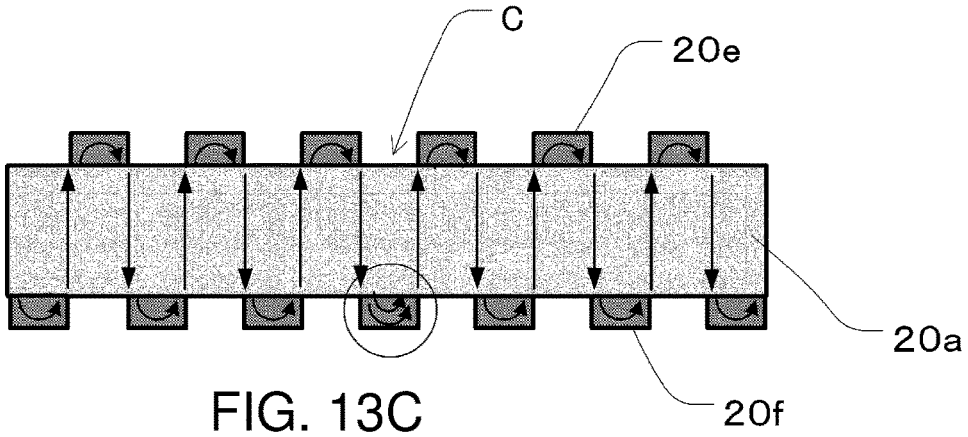

Now, a crack C is assumed to be formed in the fixing film 20. FIG. 13A is a front schematic diagram illustrating that the crack C is formed in the fixing film 20 in FIG. 12A. FIG. 13B is a sectional schematic diagram of the fixing film 20 in FIG. 13A taken along line D16 in a thickness direction of a cracked portion of the fixing film 20. FIG. 13C is a sectional schematic diagram of the fixing film 20 in FIG. 13A taken along line D17 in a thickness direction of a portion of the fixing film 20 in which no cracking has occurred.

In the present example, the low-resistance layer 20*e* or the low-resistance layer 20*f* is present at any portions of the heat generating layer 20*a* on the outer surface or inner surface thereof. Thus, wherever in the heat generating layer the crack C is formed, paths of currents I flowing through the low-resistance layers 20*e*, 20*f* in the longitudinal direction of the fixing film 20 are inevitably present, such as an encircled portion in FIG. 13C. In Embodiments 1 to 3, if a crack C is formed in the heat generating layer between the low-resistance layers 1*e*, as depicted in FIG. 5A and FIG. 5B, portions of the heat generating layer 1*a* at which no cracking has occurred in the same circumferential direction have a current density increased by the amount of currents I bypassing the crack C in the circumferential direction. Thus, although abnormal heat generation is prevented, the amount of heat generated by the portions at which no cracking has occurred increases consistently with the length of the crack C. In the present example, the currents I bypassing the crack C in the circumferential direction in FIG. 13B inevitably flow through the low-resistance layers 20*e*, 20*f*, and only a small amount of heat is generated. Thus, the amount of heat generated by the portions at which no cracking has occurred can be restrained from increasing.

As described above, in Embodiment 4, a plurality of the low-resistance layers 20*e* and 20*f* that offer lower resistance than the heat generating layer 20*a*, are formed on the opposite surfaces of the heat generating layer 20*a*. A low-resistance layer 20*e*, 20*f* is present at many positions of the heat generating layer 20*a* on the outer surface or the inner surface thereof. When the heat generating layer 20*a* is cracked, the configuration, as described above, enables a reduction in local current concentration, allowing possible abnormal heat generation to be prevented.

Embodiment 5

Figure 14A:
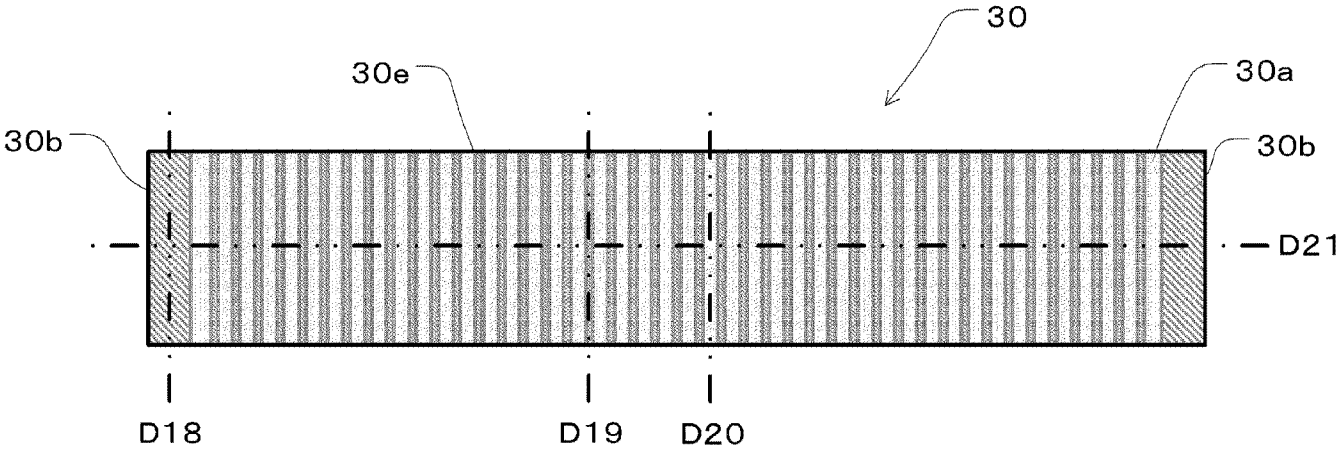
FIG. 14A and FIG. 14B are schematic diagrams of a fixing film serving as a heating rotating member according to Embodiment 5 of the present invention.
Figure 14B:
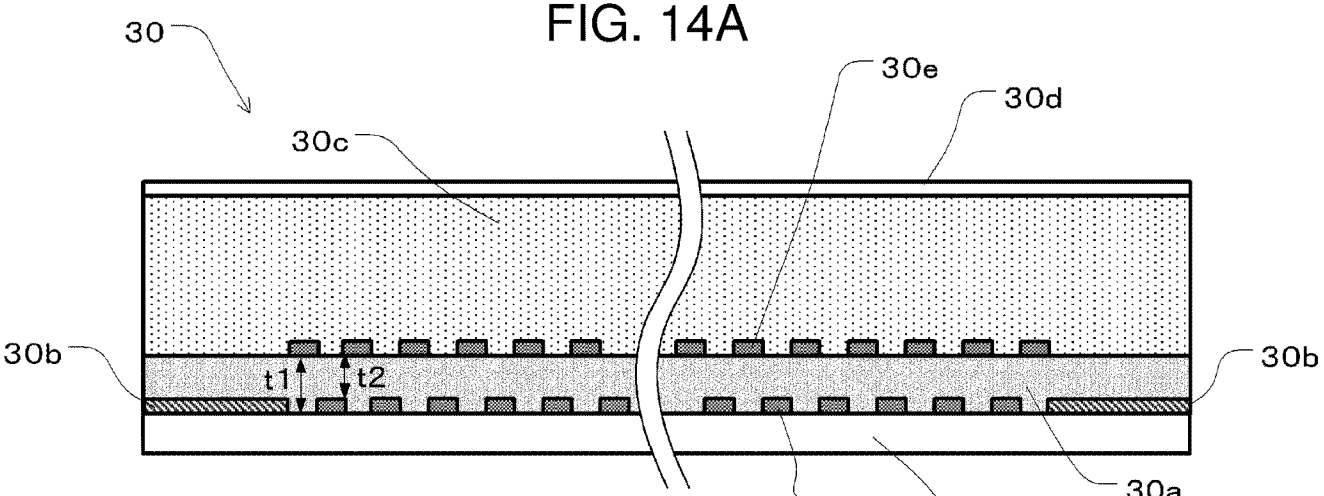
Figure 15A:
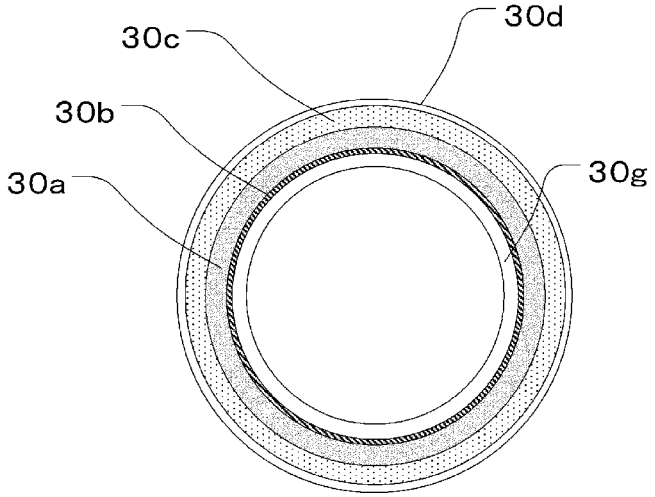
FIGS. 15A to 15C are sectional schematic diagrams of the fixing film shown in FIG. 14A and FIG. 14B.
Figure 15B:
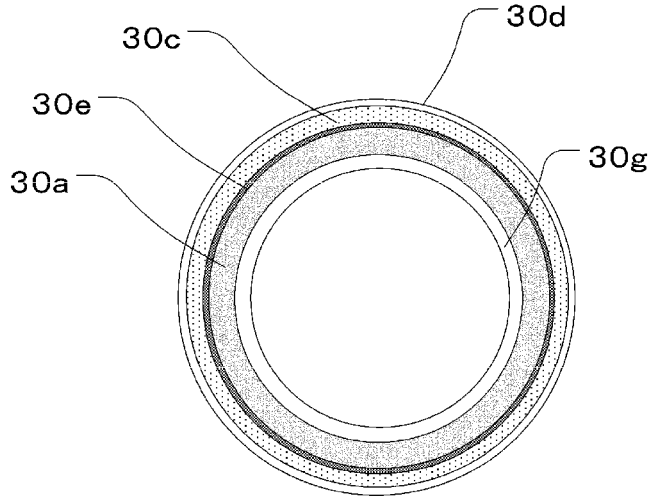
Figure 15C:
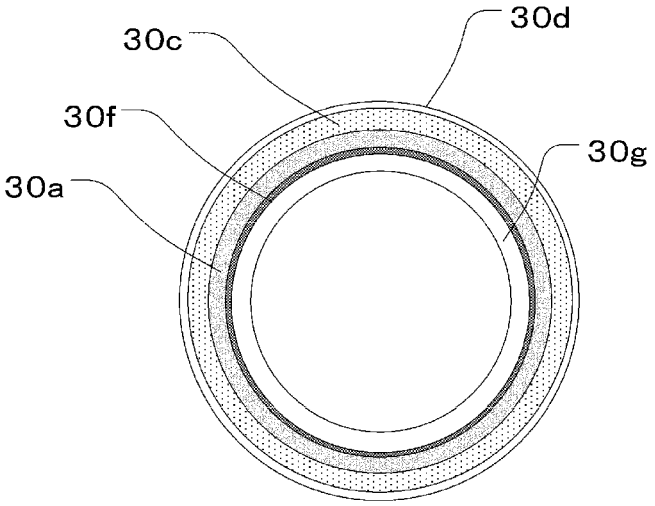

Now, a configuration of a fixing film 30 in Embodiment 5 of the present invention will be described using FIG. 14A and FIG. 14B and FIG. 15A to FIG. 15C. FIG. 14A is a schematic diagram illustrating arrangement of low-resistance layers 30*e* as viewed from the front. FIG. 15A is a sectional view of a longitudinal end of the fixing film 30 taken along line D18 in FIG. 14A. FIG. 15B and FIG. 15C are sectional views of a portion of the fixing film 30 near a longitudinally central portion thereof at which the low-resistance layer 30*e* is provided on an outer surface and a portion of the fixing film 30 near the longitudinally central portion thereof at which no low-resistance layer 30*e* is provided on the outer surface, taken along lines D19 and D20 in FIG. 14A, respectively. FIG. 14B is a sectional view of the fixing film 30 taken along line D21 in FIG. 14A in the longitudinal direction. In Embodiment 5, a high-resistance layer 30*g* is provided on the inner surface of the fixing film 20 in Embodiment 4.

The high-resistance layer 30*g* is formed of a material offering higher resistance than a heat generating layer 30*a*. The volume resistivity of the high-resistance layer 30*g* was adjusted to approximately 0.3 Ω·cm by dispersing a slight amount of carbon in polyimide. The thickness of the high-resistance layer 30*g* was set to 50 μm. Then, conductive layers 30*b* and low-resistance layers 30*f* were formed on the high-resistance layer 30*g*, and the heat generating layer 30*a* was formed on the high-resistance layer 30*g* to a thickness of 85 μm. The heat generating layer 30*a* is formed of the same material as that of the heat generating layer 20*a* in Embodiment 4. A distance t1 in FIG. 14B represents the thickness of the heat generating layer 30*a*. Then, a layer configuration in the present embodiment can be obtained by firing the heat generating layer 30*a* and then forming low-resistance layers 30*e* on the heat generating layer 30*a*. Conductive layers 30*b*, an elastic layer 30*c*, and a release layer 30*d* have configurations similar to the corresponding configurations in Embodiment 4, and will thus not be described.

As a material for the low-resistance layers 30*e* on the heat generating layer 30*a* and the low-resistance layers 30*f* on the high-resistance layer 30*g*, a silver paste with a volume resistivity of $4\times10^{-5}$ Ω·cm was used, as is the case with Embodiment 4. For the low-resistance layers 30*e* and 30*f*, the thickness was approximately 10 μm, both the interval and the width were 0.3 mm, and the pitch was 0.6 mm. The low-resistance layers 30*e*, 30*f* were formed such that the low-resistance layers 30*e* were shifted in phase from the low-resistance layers 30*f* by 0.3 mm. An interval t2 between the low-resistance layers 30*e* and 30*f* in the thickness direction of the heat generating layer 30*a* is 75 μm. The distance between the low-resistance layers 30*e*, 30*f* on the same surface (30*e*-30*e*, 30*f*-30*f*) is 0.3 mm, and the distance between the low-resistance layers 30*e*, 30*f* in the thickness direction (30*e*-30*f*) is 75 μm. Both distances are the same as the corresponding distances in Embodiment 4, meaning that the resistance value in Embodiment 5 is the same as the resistance value in Embodiment 4.

Furthermore, in the present embodiment, the low-resistance layers 30*e* on the heat generating layer 30*a* and the low-resistance layers 30*f* on the high-resistance layer 30*g* are formed of the same silver paste. Different materials, however, may be used for the low-resistance layers 30*e* and for the low-resistance layers 30*f*, so long as the materials have a smaller volume resistivity than that of the heat generating layer 30*a*.

In Embodiment 4, if the low-resistance layers 20*e*, 20*f* are formed on the inner surface of the fixing film 20, since the fixing film inner surface is rubbed by the film guide 2 or the temperature sensing element 6 illustrated in FIG. 3A and FIG. 3B, the low-resistance layers 20*e*, 20*f* may be worn off.

If the wear of the low-resistance layers 20*e*, 20*f* progresses to partly eliminate the low-resistance layers 20*e*, 20*f*, the effects of the present invention fail to be produced. Thus, the low-resistance layers 20*e*, 20*f* can be prevented from being worn off by providing the high-resistance layer 30*g* on the fixing film inner surface as a protective layer as in Embodiment 5.

Embodiments 4 and 5, described above, may be applied to the fixing roller 10 described in Embodiment 2. Furthermore, in Embodiments 4 and 5, the width and the interval of the low-resistance layers 20*e*, 20*f*, 30*e*, 30*f* are the same for the inner peripheral surface and for the outer peripheral surface. The width and the interval of the low-resistance layers 20*e*, 20*f*, 30*e*, 30*f* may, however, locally vary, as disclosed in Embodiment 3 by way of example. The effects of the invention in Embodiments 4 and 5 can be produced so long as, in the thickness direction of the heat generating layer 20*a*, 30*a*, the low-resistance layer 20*e*, 20*f*, 30*e*, 30*f* is present at any positions of the heat generating layer 20*a*, 30*a* on the outer surface or the inner surface thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

We claim:

1. A tubular film used for a fixing apparatus, the tubular film comprising:

a heat generating layer having a tubular shape;

a first conductive layer and a second conductive layer provided, respectively, at one end and another end of the film in a longitudinal direction of the film so as to contact the heat generating layer, the first conductive layer and the second conductive layer each having a volume resistivity that is less than that of the heat generating layer, and each having an annular shape extending in a circumferential direction of the heat generating layer; and a low resistance layer overlapping with the heat generating layer, with respect to a thickness direction of the heat generating layer, in an area of the heat generating layer between the first conductive layer and the second conductive layer in the longitudinal direction, and contacting the heat generating layer, so as not to contact the first conductive layer and the second conductive layer, the low resistance layer having a volume resistivity that is less than that of the heat generating layer, and having an annular shape extending in the circumferential direction of the heat generating layer.

2. The film according to claim 1, wherein a ratio of the volume resistivity of the low resistance layer to the volume resistivity of the heat generating layer is between 1/1000 and 1/100.

3. The film according to claim 1, wherein a thickness of the low resistance layer is 5 μm or more to 100 μm or less.

4. The film according to claim 1, wherein a width of the low resistance layer is 0.1 mm or more to 5 mm or less.

5. The film according to claim 1, wherein the conductive layers are provided on an outer side of the heat generating layer.

6. The film according to claim 1, wherein the conductive layers are formed of the same material as that of the low resistance layer.

7. The film according to claim 1, wherein a plurality of low resistance layers are provided at intervals.

8. The film according to claim 7, wherein an interval between two adjacent low resistance layers, of the plurality of low resistance layers, is between (i) 0.2 mm or more and (ii) a value equal to or less than a circumferential length of the heat generating layer.

9. The film according to claim 7, wherein the low-resistance layers, of the plurality of low resistance layers, are provided alternately on an outer side and an inner side of the heat generating layer in the longitudinal direction.

10. The film according to claim 7, wherein the intervals, at which the low resistance layers, of the plurality of low resistance layers, are provided, vary between a central portion of the heat generating layer and each end of the heat generating layer in the longitudinal direction.

11. A fixing apparatus that fixes an image, formed on a recording material, onto the recording material, the fixing apparatus comprising:

(A) a tubular film configured to contact the recording material, the film having:

(a) a heat generating layer having a tubular shape;

(b) a first conductive layer and a second conductive layer provided, respectively, at one end and another end of the film in a longitudinal direction of the film so as to contact the heat generating layer, the first conductive layer and the second conductive layer each having a volume resistivity that is less than that of the heat generating layer, and each having an annular shape extending in a circumferential direction of the heat generating layer; and (c) a low resistance layer overlapping with the heat generating layer, with respect to a thickness direction of the heat generating layer, in an area of the heat generating layer between the first conductive layer and the second conductive layer in the longitudinal direction, and contacting the heat generating layer, so as not to contact the first conductive layer and the second conductive layer, the low resistance layer having a volume resistivity that is less than that of the heat generating layer, and having an annular shape extending in the circumferential direction of the heat generating layer;

(B) a roller configured to form a fixing nip portion for nipping and conveying the recording material together with the film, wherein the image formed on the recording material is fixed onto the recording material at the fixing nip portion; and (C) power feeding members that contact the first conductive layer and the second conductive layer, respectively, and supply power to the heat generating layer for generating heat.

12. A fixing apparatus that fixes an image, formed on a recording material, onto the recording material, the fixing apparatus comprising:

(A) a heating rotating member configured to contact the recording material, the heating rotating member having:

(a) a heat generating layer;

(b) a first conductive layer and a second conductive layer provided, respectively, at one end and another end of the heating rotating member in a longitudinal direction of the heating rotating member so as to contact the heat generating layer, the first conductive layer and the second conductive layer each having a volume resistivity that is less than that of the heat generating layer, and each having an annular shape extending in a circumferential direction of the heat generating layer; and (c) a first low resistance layer and a second low resistance layer provided, respectively, in an area of the heat generating layer between the first conductive layer and the second conductive layer in the longitudinal direction, and contacting the heat generating layer, so as not to contact the first conductive layer and the second conductive layer, each of the first low resistance layer and the second low resistance layer having a volume resistivity that is less than that of the heat generating layer, and having an annular shape extending in the circumferential direction of the heat generating layer, wherein the first low resistance layer is provided next to the first conductive layer through a first interval, and the second low resistance layer is provided next to the first low resistance layer through a second interval; and (B) power feeding members that contact the first conductive layer and the second conductive layer, respectively, and supply power to the heat generating layer for generating heat, wherein a current that flows through the first conductive layer and the heat generating layer positioned at the first interval flows through the first low resistance layer, and a current that flows through the first low resistance layer and the heat generating layer positioned at the second interval flows through the second low resistance layer.

13. The fixing apparatus according to claim 12, further comprising (C) a roller configured to form a fixing nip portion for nipping and conveying the recording material together with the film, wherein the image formed on the recording material is fixed onto the recording material at the fixing nip portion.

14. The fixing apparatus according to claim 12, wherein each of the first and second intervals is between (i) 0.2 mm or more and (ii) a value equal to or less than a circumferential length of the heat generating layer.

15. The fixing apparatus according to claim 12, wherein a ratio of a volume resistivity of each of the first low resistance layer and the second low resistance layer to the volume resistivity of the heat generating layer is between 1/1000 and 1/100.

16. The fixing apparatus according to claim 12, wherein a thickness of each of the first low resistance layer and the second low resistance layer is 5 μm or more to 100 μm or less.

17. A tubular film used for a fixing apparatus, the tubular film comprising:

a heat generating layer having a tubular shape;

a first conductive layer and a second conductive layer provided, respectively, at one end and another end of the film in a longitudinal direction of the film so as to contact the heat generating layer, the first conductive layer and the second conductive layer each having a volume resistivity that is less than that of the heat generating layer, and each having an annular shape extending in a circumferential direction of the heat generating layer; and a first low resistance layer and a second low resistance layer provided, respectively, in an area of the heat generating layer between the first conductive layer and the second conductive layer in the longitudinal direction, and contacting the heat generating layer, so as not to contact the first conductive layer and the second conductive layer, each of the first low resistance layer and the second low resistance layer having a volume resistivity that is less than that of the heat generating layer, and having an annular shape extending in the circumferential direction of the heat generating layer, wherein the first low resistance layer is provided next to the first conductive layer through a first interval, and the second low resistance layer is provided next to the first low resistance layer through a second interval, wherein, when a voltage is applied between the first conductive layer and the second conductive layer, a current that flows through the first conductive layer and the heat generating layer positioned at the first interval flows through the first low resistance layer, and a current that flows through the first low resistance layer and the heat generating layer positioned at the second interval flows through the second low resistance layer.

18. The film according to claim 17, wherein a ratio of the volume resistivity of one of the first and second low resistance layers to the volume resistivity of the heat generating layer is between 1/1000 and 1/100.

19. The film according to claim 17, wherein a thickness of each of the first and second low resistance layers is 5 μm or more to 100 μm or less.

20. The film according to claim 17, wherein a width of each of the first and second low resistance layers is 0.1 mm or more to 5 mm or less.

21. The film according to claim 17, wherein the first and second low resistance layers are provided alternately on an outer side and an inner side of the heat generating layer in the longitudinal direction.

* * * * *